US009662895B1

(12) United States Patent
Okuno

(10) Patent No.: US 9,662,895 B1
(45) Date of Patent: May 30, 2017

(54) LIQUID CONTAINER AND LIQUID SUPPLY APPARATUS

(71) Applicant: SEIKO EPSON CORPORATION, Tokyo (JP)

(72) Inventor: Tokujiro Okuno, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/188,156

(22) Filed: Jun. 21, 2016

(51) Int. Cl.
*B41J 2/15* (2006.01)
*B41J 2/175* (2006.01)

(52) U.S. Cl.
CPC ..... *B41J 2/17523* (2013.01); *B41J 2/17526* (2013.01)

(58) Field of Classification Search
CPC ..... B41J 2/175; B41J 2/1752; B41J 2/17513; B41J 2/17503; B41J 2002/14419
See application file for complete search history.

(56) References Cited

U.S. PATENT DOCUMENTS 8,752,941 B2 * 6/2014 James, III ..... B41J 2/1752 347/84
8,833,905 B2 * 9/2014 Kanbe ..... B41J 2/17526 347/49

FOREIGN PATENT DOCUMENTS

JP 2009-202346 A 9/2009
JP 2016-007786 A 1/2016

* cited by examiner

*Primary Examiner* — Lamson Nguyen
(74) *Attorney, Agent, or Firm* — Global IP Counselors, LLP

(57) ABSTRACT

An ink container, which is able to be attached to and detached from a liquid supply apparatus which supplies liquid to a liquid ejecting apparatus, provided with an ink containing section which has flexibility and which contains the ink, a base member which is positioned on an end section of the ink containing section and which protrudes more to the outer side than the ink containing section, an ink extraction section which is provided in the base member and which forms a flow path which is linked with an inner section of the ink containing section via the base member, and a handle which is provided so as to be able to be rotated with regard to the base member.

12 Claims, 20 Drawing Sheets

LIQUID CONTAINER AND LIQUID SUPPLY APPARATUS

TECHNICAL FIELD

The present invention relates to a liquid container, a liquid supply apparatus, and the like.

PRIOR ART

Ink jet printers are known in the prior art as one example of a liquid ejecting apparatus. Typically, it is possible for ink jet printers to perform printing onto a recording medium such as a paper sheet by ejecting ink from a recording head toward the recording medium. Among these printers, a configuration is known in the prior art where an external ink supply apparatus (a liquid supply apparatus) is connected in order to supply ink stably to the recording head (for example, refer to PTL 1).

CITATION LIST

Patent Literature

PTL 1: Japanese Unexamined Patent Application Publication No. 2009-202346

SUMMARY OF THE INVENTION

Problems to be Solved by the Invention

In the external ink supply apparatus which is described in PTL 1 described above, an ink supply tube (one example of a liquid introduction section) is connected with a connection section (one example of a liquid extraction section) of an ink bag. Then, ink inside the ink bag is supplied from the connection section to the printer via the ink supply tube. In the external ink supply apparatus described above, the connection section which is connected with the ink supply tube is positioned on the lower side of the ink bag in the vertical direction. For this reason, it is difficult to visually confirm, for example, the connection section of the ink bag such as when swapping ink bags. For this reason, there is a problem with the liquid containers and the liquid supply apparatuses in the prior art in that it is difficult for the liquid introduction section to be attached to and detached from the liquid extraction section.

Means to Solve the Problems

The present invention enables at least a portion of the problems described above to be resolved and can be realized as the following aspects and applied examples.

Applied Example 1

A liquid container which is able to be attached to and detached from a liquid supply apparatus which supplies liquid to a liquid ejecting apparatus, where the liquid container is provided with a liquid containing section which has flexibility and which contains the liquid, a base member which is positioned on an end section of the liquid containing section and which protrudes more to the outer side than the liquid containing section, a liquid extraction section which is provided in the base member and which forms a flow path which is linked with an inner section of the liquid containing section via the base member, and a handle section which is provided so as to be able to be rotated with regard to the base member.

With the liquid container of this applied example, it is easy for the liquid container to be attached to and detached from the liquid supply apparatus since it is easy to move the liquid container by gripping the handle section. In addition, with the liquid container, it is easy for bending of the liquid containing section back and forth to be avoided when, for example, the liquid container is shaken side to side in a state where the handle section is held since the handle section is able to be rotated with regard to the base member. Due to this, it is easy for damage to the liquid containing section to be suppressed.

Applied Example 2

The liquid container described above where an end surface of the liquid extraction section faces toward a direction which intersects with the protruding direction of the handle section from the base member when the liquid container is supported by the handle section being gripped and the handle section protrudes more to the opposite side to the liquid containing section side than the base member.

With this applied example, it is easy for the liquid extraction section to be visually confirmed and it is possible for mounting onto the liquid supply apparatus to be performed while taking into consideration the end surface of the liquid extraction section since it is difficult for the end surface of the liquid extraction section to overlap with the handle section when the liquid container is supported by the handle section being gripped and the handle section protrudes more to the opposite side to the liquid containing section side than the base member.

Applied Example 3

The liquid container described above where the base member is further provided with a contact section which is able to connect with an electricity connection section which is provided in the liquid supply apparatus.

With this applied example, connection is easy since connection of the liquid extraction section to a liquid introduction section is possible and connection of the contact section to the electricity connection section of the liquid supply apparatus is possible when the liquid container is mounted onto the liquid supply apparatus by the handle being gripped.

Applied Example 4

The liquid container described above where the liquid container is provided with a first engagement section which is able to engage with the liquid supply apparatus, the first engagement section is provided on the handle section of the liquid container, the liquid supply apparatus is provided with a first support section which supports the liquid extraction section of the liquid container, a liquid introduction section which is connected with the liquid extraction section and which is supplied with the liquid, which is inside the liquid containing section, from the liquid extraction section, and a second support section which supports the first engagement section of the handle section, the liquid extraction section and the liquid introduction section are connected to each other when the handle section is rotated in a first rotation direction with the first engagement section of the handle section as a pivot from a state where connection between the liquid extraction section and the liquid introduction section is released, and connection between the liquid extraction section and the liquid introduction section is released when the handle section is rotated in a second rotation direction which is opposite to the first rotation direction with the first engagement section of the handle section as a pivot from a state where the liquid extraction section and the liquid introduction section are connected to each other.

With this applied example, the liquid extraction section and the liquid introduction section are connected to each other when the handle section is rotated in the first rotation direction with the first engagement section as a pivot in a state where the first engagement section which is provided in the handle section of the liquid container is supported by the second support section of the liquid supply apparatus. In addition, connection between the liquid extraction section and the liquid introduction section is released when the handle section is rotated in the second rotation direction with the first engagement section as a pivot from a state where the liquid extraction section and the liquid introduction section are connected to each other. For this reason, according to the liquid supply apparatus, it is easy for the liquid container to be attached to and detached from the liquid supply apparatus by the handle section being rotated.

Applied Example 5

The liquid container described above where a third engagement section is provided in the liquid extraction section of the liquid container, the third engagement section engages with the first support section of the liquid supply apparatus, and the liquid extraction section is supported by the first support section via the third engagement section.

With this applied example, due to the third engagement section being provided in the liquid extraction section of the liquid container, it is possible for it to be easy for the liquid container to be attached to and detached from the liquid supply apparatus by the third engagement section engaging with the first support section of the liquid supply apparatus.

Applied Example 6

A liquid supply apparatus which is mounted with a liquid container, which contains liquid, so as to be able to be attached and detached and which is able to supply a liquid ejecting apparatus with the liquid which is contained in the liquid container, where the liquid container is provided with a liquid containing section which has flexibility and which contains the liquid, a base member which is positioned on an end section of the liquid containing section and which protrudes more to the outer side than the liquid containing section, a liquid extraction section which is provided in the base member to protrude from the base member and which forms a flow path which is linked with an inner section of the liquid containing section via the base member, a handle section which is provided so as to be able to be rotated with regard to the base member, and a first engagement section which is provided on the handle section and which is able to engage with the liquid supply apparatus, the first engagement section which is provided on the handle section of the liquid container, the liquid supply apparatus is provided with a first support section which supports the liquid extraction section, a liquid introduction section which is connected with the liquid extraction section and which is supplied with the liquid, which is inside the liquid containing section, from the liquid extraction section, and a second support section which supports the first engagement section of the handle section, where the liquid extraction section and the liquid introduction section are connected to each other when the handle section is rotated in a first rotation direction with the first engagement section of the handle section as a pivot from a state where connection between the liquid extraction section and the liquid introduction section is released, and connection between the liquid extraction section and the liquid introduction section is released when the handle section is rotated in a second rotation direction which is opposite to the first rotation direction with the first engagement section of the handle section as a pivot from a state where the liquid extraction section and the liquid introduction section are connected to each other.

With the liquid supply apparatus of this applied example, the liquid extraction section and the liquid introduction section are connected to each other when the handle section is rotated in the first rotation direction with the first engagement section as a pivot in a state where the first engagement section which is provided in the handle section of the liquid container is supported by the second support section of the liquid supply apparatus. In addition, connection between the liquid extraction section and the liquid introduction section is released when the handle section is rotated in the second rotation direction with the first engagement section as a pivot from a state where the liquid extraction section and the liquid introduction section are connected to each other. For this reason, according to the liquid supply apparatus, it is easy for the liquid container to be attached to and detached from the liquid supply apparatus by the handle section being rotated.

Applied Example 7

The liquid supply apparatus described above where an end surface of the liquid extraction section faces toward a direction which intersects with the protruding direction of the handle section from the base member when the liquid container is supported by the handle section being gripped and the handle section protrudes more to the opposite side to the liquid containing section side than the base member.

With this applied example, it is easy for the liquid extraction section to be visually confirmed and it is possible for mounting onto the liquid supply apparatus to be performed while taking into consideration the end surface of the liquid extraction section since it is difficult for the end surface of the liquid extraction section to overlap with the handle section when the liquid container is supported by the handle section of the liquid container being gripped and the handle section protrudes more to the opposite side to the liquid containing section side than the base member.

Applied Example 8

The liquid supply apparatus described above where the liquid extraction section and the liquid introduction section line up in a first direction which intersects with the direction of gravity when the liquid extraction section of the liquid container is supported by the first support section of the liquid supply apparatus, the handle section is further provided with a second engagement section which engages with the base member so as to be able to be rotated, an engagement target section, which engages with the second engagement section of the handle section and which is able to slide with the second engagement section, is formed in the base member, the engagement target section extends in a second direction which intersects with the first direction in a state where the liquid extraction section is supported by the first support section of the liquid supply apparatus, and the position of the first engagement section of the handle section is higher than the position of the second engagement section in a state where connection between the liquid extraction section and the liquid introduction section is released.

With this applied example, due to the position of the first engagement section of the handle section being higher than the position of the second engagement section in a state where connection between the liquid extraction section and the liquid introduction section is released, the position of the second engagement section in the first direction changes with regard to the first engagement section when the handle section is rotated. Due to this, since it is possible for the position of the liquid extraction section in the first direction to change with regard to the first engagement section, it is possible for the distance between the liquid extraction section and the liquid introduction section in the first direction to change. Due to this, according to the liquid supply apparatus, it is possible for the liquid extraction section and the liquid introduction section to be connected to each other and for connection between the liquid extraction section and the liquid introduction section to be released by the handle section being rotated.

Applied Example 9

The liquid supply apparatus described above where the first support section of the liquid supply apparatus is shifted by the handle section of the liquid container being rotated.

With this applied example, due to the first support section of the liquid supply apparatus being shifted by the handle section of the liquid container being rotated, it is possible for the liquid extraction section and the liquid introduction section to be connected to each other and for connection between the liquid extraction section and the liquid introduction section to be released.

Applied Example 10

The liquid supply apparatus described above where a third engagement section is provided in the liquid extraction section of the liquid container, the third engagement section engages with the first support section of the liquid supply apparatus, and the liquid extraction section is supported by the first support section via the third engagement section.

With this applied example, due to the third engagement section being provided in the liquid extraction section of the liquid container, it is possible for it to be easy for the liquid container to be attached to and detached from the liquid supply apparatus by the third engagement section engaging with the first support section of the liquid supply apparatus.

Applied Example 11

A liquid container which is able to be attached to and detached from a liquid supply apparatus which supplies liquid to a liquid ejecting apparatus, where the liquid container is provided with a liquid containing section which has flexibility and which contains the liquid, a base member which is positioned on an end section of the liquid containing section and which protrudes more to the outer side than the liquid containing section, a liquid extraction section which is provided in the base member, which forms a flow path which is linked with an inner section of the liquid containing section via the base member, and which has an end surface which is open to the outside, a handle section which is provided so as to be able to be rotated with regard to the base member between a first state along a first hypothetical plane which is parallel with the end surface of the liquid extraction section and a second state along a second hypothetical plane which intersects with the end surface of the liquid extraction section, and a first engagement section which is an engagement section, which is provided in the handle section and which is able to engage with the liquid supply apparatus, and which is a pivot for rotation when the handle section rotates from the first state to the second state and where it is possible for the base member to be operated so that the end surface of the liquid extraction section moves in a direction toward the end surface.

With the liquid container of this applied example, it is possible for the end surface of the liquid extraction section to move in a direction toward the end surface by the handle section being rotated due to the first engagement section of the handle section engaging with the liquid supply apparatus. For this reason, it is possible to easily perform connection with the liquid introduction section which is positioned at the destination to which the ink extraction section will be moved.

Applied Example 12

The liquid container described above where an end surface of the liquid extraction section faces toward a direction which intersects with the protruding direction of the handle section from the base member when the liquid container is supported by the handle section being gripped and the handle section protrudes more to the opposite side to the liquid containing section side than the base member.

With this applied example, it is easy for the liquid extraction section to be visually confirmed and it is possible for mounting onto the liquid supply apparatus to be performed while taking into consideration the end surface of the liquid extraction section since it is difficult for the end surface of the liquid extraction section to overlap with the handle section when the liquid container is supported by the handle section being gripped and the handle section protrudes more to the opposite side to the liquid containing section side than the base member.

DESCRIPTION OF THE EMBODIMENTS

An embodiment will be described with a liquid ejecting system as an example while referencing the diagrams. Here, there are times when the scale of the configuration and members differs in each of the diagrams in order for each of the configurations to a size to an extent where recognition is possible.

Figure 1:
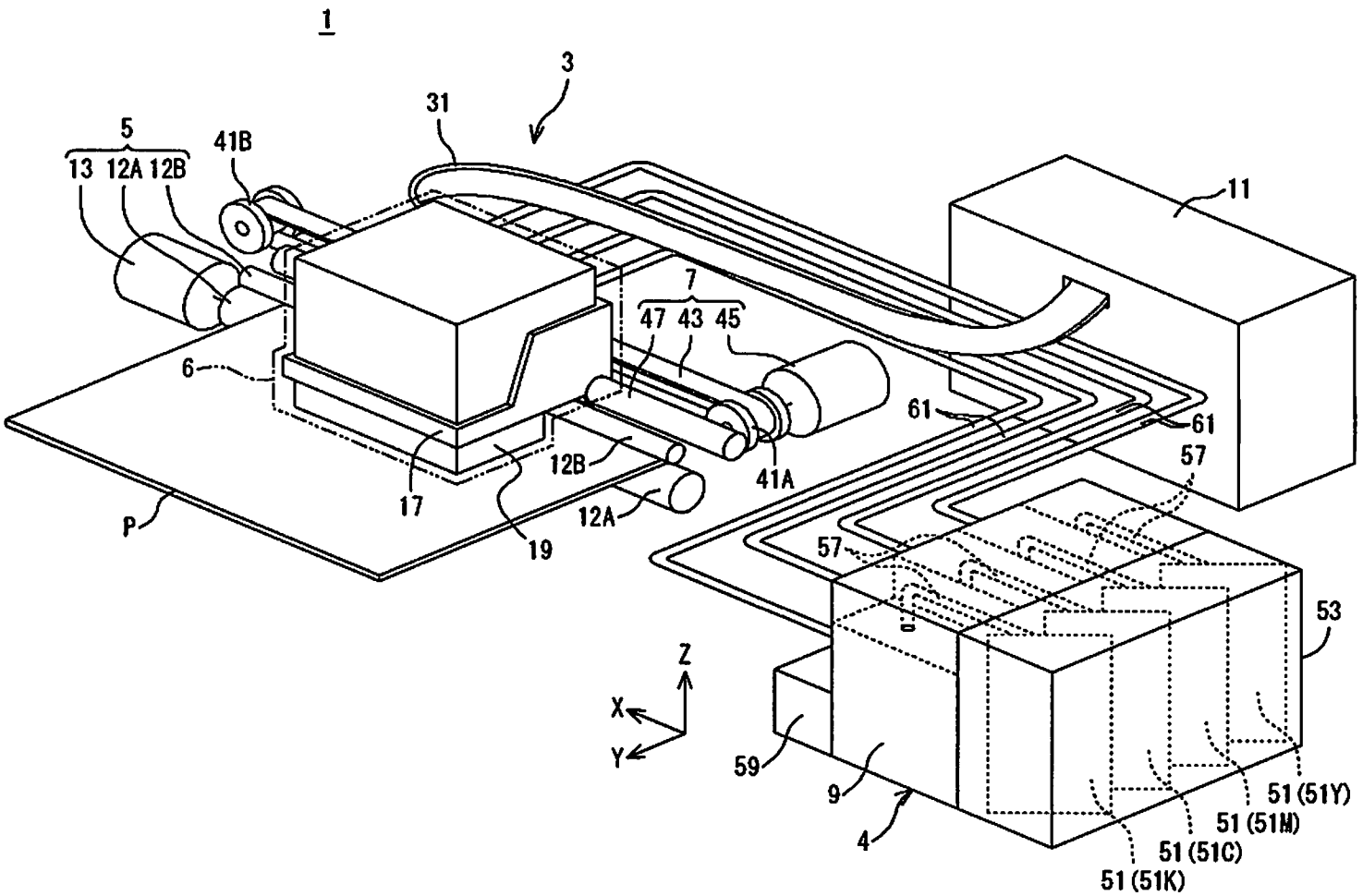
FIG. 1 is a perspective diagram illustrating the important configurations of a printer in an embodiment of the present invention.
Figure 2:
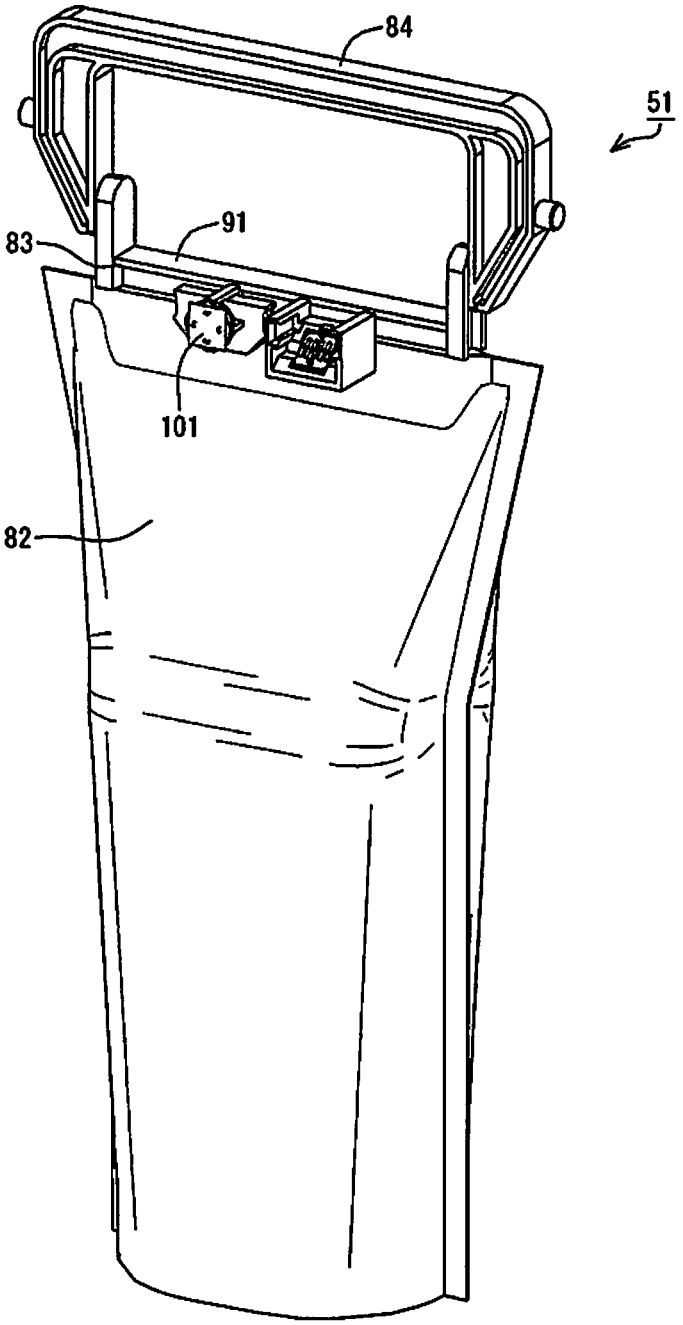
FIG. 2 is a perspective diagram illustrating an ink container in an embodiment of the present invention.

A liquid ejecting system 1 as the present embodiment has a printer 3 which is one example of a liquid ejecting apparatus and an ink supply apparatus 4 which is one example of a liquid supply apparatus as shown in FIG. 1. The printer 3 has a transport apparatus 5, a recording section 6, a movement apparatus 7, a relay apparatus 9, and a control section 11. Here, the XYZ axes, which are coordinate axes which are orthogonal with each other, are applied in FIG. 1. The XYZ axes are applied according to requirements in other diagrams in which the axes are shown. The state where the liquid ejecting system 1 is being used in the present embodiment is a state where the liquid ejecting system 1 is placed on a horizontal flat surface (XY plane) which is regulated in the X axis and Y axis. The Z axis is an axis which is orthogonal to the horizontal flat plane. The Z axis direction is a vertically upward direction in the state where the liquid ejecting system 1 is being used. Then, −Z axis direction is a vertically downward direction in FIG. 1 in the state where the liquid ejecting system 1 is being used. Here, for each of the XYZ axes, the direction of the arrows indicates a + (plus) direction and the direction which is opposite to the direction of the arrows indicates a − (minus) direction.

The transport apparatus 5 transports a recording medium P such as a paper sheet for recording intermittently in the Y axis direction. The recording section 6 performs recording using ink which is one example of a liquid onto the recording medium P which is being transported using the transport apparatus 5. The movement apparatus 7 moves the recording section 6 back and forth along the X axis. The ink supply apparatus 4 supplies ink to the recording section 6 via the relay apparatus 9. The relay apparatus 9 is provided between the ink supply apparatus 4 and the recording section 6 and relays ink from the ink supply apparatus 4 to the recording section 6. The control section 11 controls driving of each of the configurations described above.

The transport apparatus 5 has a drive roller 12A, a driven roller 12B, and a transport motor 13 as shown in FIG. 1. The drive roller 12A and the driven roller 12B are configured so as to be able to be rotated by the outer circumferences combining together with each other. The transport motor 13 generates motive force for driving the drive roller 12A to rotate. The motive force from the transport motor 13 is transferred to the drive roller 12A via a transmission mechanism. Then, the recording medium P which is interposed between the drive roller 12A and the driven roller 12B is transported intermittently in the Y axis direction.

The recording section 6 is provided with a carriage 17 and a recording head 19. The recording head 19 performs recording onto the recording medium P by ink being discharged as ink droplets. The carriage 17 is mounted with the recording head 19. Here, the recording head 19 is connected with the control section 11 via a flexible cable 31. Discharging of ink droplets from the recording head 19 is controlled using the control section 11.

The movement apparatus 7 is provided with a timing belt 43, a carriage motor 45, and a guide shaft 47 as shown in FIG. 1. The timing belt 43 spans across between a pulley 41A and a pulley 41B which are a pair. The pair of pulley 41A and pulley 41B line up along the X axis. For this reason, the timing belt 43 spans across along the X axis. A carriage motor 45 generates motive power for driving the pulley 41A to rotate. The guide shaft 47 extends along the X axis. Both ends of the guide shaft 47 are supported by a casing which is not shown in the diagrams and the guide shaft 47 guides the carriage 17 along the X axis.

The carriage 17 is fixed to a portion of the timing belt 43. In the carriage 17, motive force is transferred from the carriage motor 45 via the pulley 41A and the timing belt 43. Then, the carriage 17 is configured so as to be able to move back and forth along the X axis using the motive force which is transferred.

Ink containers 51 which are one example of a liquid container are mounted onto the ink supply apparatus 4 as shown in FIG. 1 so as to be freely attachable and detachable. The ink supply apparatus 4 has a case 53. Here, it is possible for a plurality (four in the present embodiment) of the ink containers 51 to be mounted onto the ink supply apparatus 4 in the present embodiment. The four ink containers 51 are contained in the case 53. An attaching and detaching unit (which will be described later) which supports the ink containers 51 is provided in the case 53. The four ink containers 51 are supported so as to be able to be attached and detached with regard to the attaching and detaching unit. Each of the ink containers 51 has an ink bag which is one example of an ink containing section. Ink is enclosed within the ink bags which are configured using sheets which have flexibility. In the liquid ejecting system 1, when ink in the ink bag is consumed, the ink container 51 is exchanged with the ink container 51 which is new.

Types of ink which are different from each other are contained in the four ink containers 51. In the present embodiment, ink which is yellow (Y), magenta (M), cyan (C), and black (K) is contained in the ink containers 51 which are different to each other. Below, the four ink containers 51 are labelled as an ink container 51Y, an ink container 51M, an ink container 51C, and an ink container 51K in cases where the four ink containers 51 are to be separately identified for each type of ink. The ink container 51Y has an ink bag where ink which is yellow is enclosed. In the same manner, the ink container 51M has an ink bag where ink which is magenta is enclosed, the ink container 51C has an ink bag where ink which is cyan is enclosed, and the ink container 51K has an ink bag where ink which is black is enclosed.

Ink supply tubes 57 are connected with the ink bags in each of the ink containers 51 via an attaching and detaching unit (which is not shown in the diagrams). The ink supply tubes 57 which are one example of a flow path member connect from the ink supply apparatus 4 to the relay apparatus 9. The relay apparatus 9 has a pump unit 59. The pump unit 59 draws out ink inside the ink containers 51 which are mounted onto the ink supply apparatus 4. Then, the pump unit 59 sends the ink which is drawn out from the ink containers 51 to the recording head 19 via ink supply tubes 61. Due to this, ink inside the ink containers 51 is supplied from the ink supply apparatus 4 to the recording head 19 via the relay apparatus 9. Then, ink which is supplied to the recording head 19 is discharged as ink droplets from nozzles (which are not shown in the diagrams) which face toward the recording medium P side.

In the liquid ejecting system 1 which has the configuration described above, driving of the transport motor 13 is controlled using the control section 11 and the transport apparatus 5 transports the recording medium P intermittently in the Y axis direction while the recording medium P opposes the recording head 19. At this time, ink droplets are discharged to predetermined positions by driving of the recording head 19 being controlled while the carriage 17 is moved back and forth along the X axis due to the control section 11 controlling driving of the carriage motor 45. Due to these actions, dots are formed on the recording medium P and recording is performed onto the recording medium P based on recording information such as image data.

Figure 3:
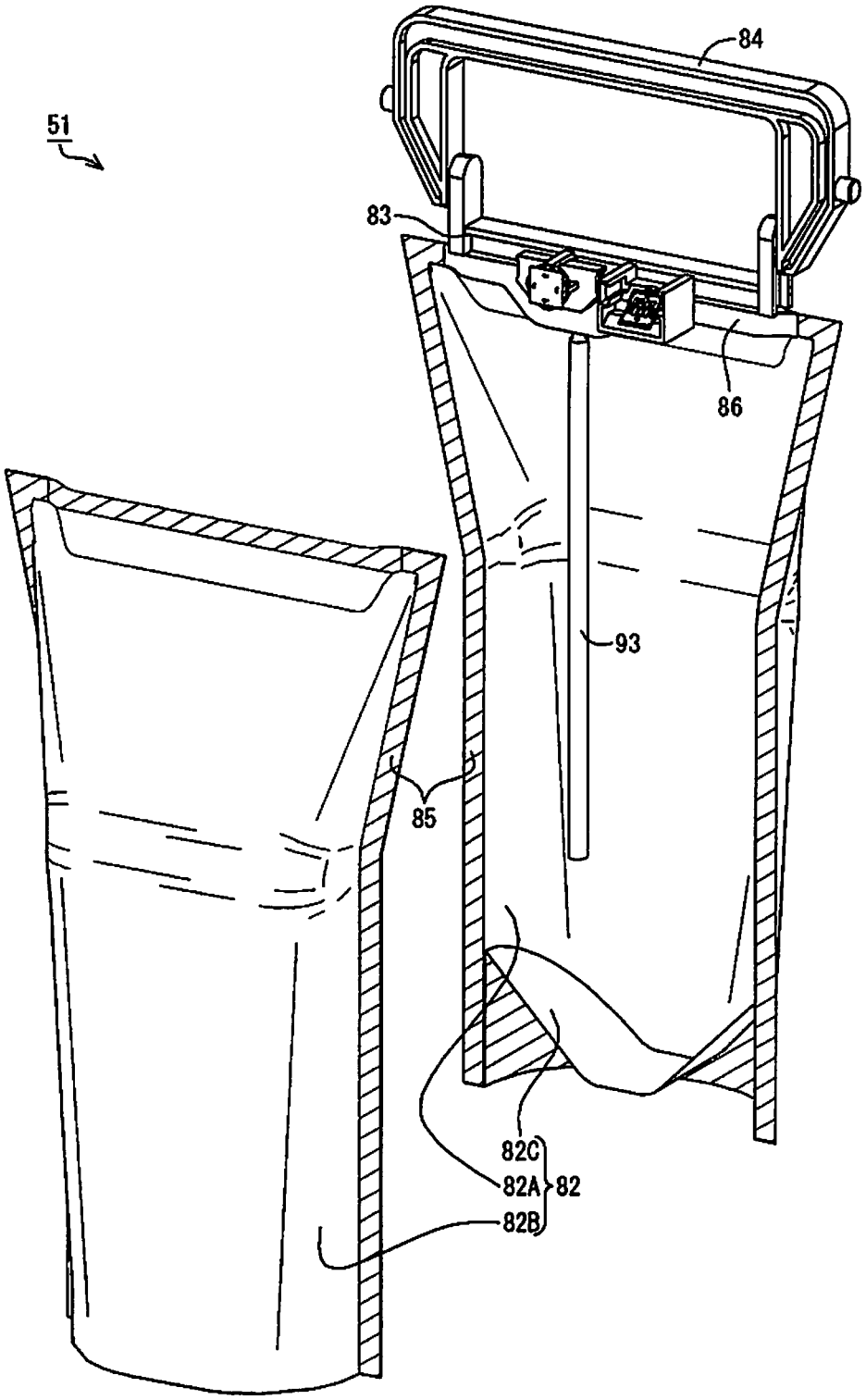
FIG. 3 is a perspective diagram illustrating a breakdown of an ink container in an embodiment of the present invention.

The ink container 51 has an ink containing section 82 which is one example of a liquid containing section, a flow path unit 83, and a handle 84. The ink containing section 82 has a sheet member 82A which has flexibility, a sheet member 82B which has flexibility, and a sheet member 82C which has flexibility as shown in FIG. 3. The sheet member 82A and the sheet member 82B are bonded to each other at a peripheral edge region 85 in a state of overlapping with each other. The sheet member 82C is interposed by the sheet member 82A and the sheet member 82B. The peripheral edge of the sheet member 82C is bonded with the sheet member 82A and the sheet member 82B in a state of overlapping with the peripheral edge region 85. Due to this, the ink containing section 82 has a format which is a bag shape where the sheet member 82C is the bottom portion. Ink is contained in the inner section of the ink containing section 82. For this reason, the ink containing section 82 has a function as an ink containing section which contains ink which is one example of a liquid. Here, shading is carried out for the peripheral edge region 85 in FIG. 3 so that the configuration is easy to understand. In addition, a state is shown in FIG. 3 where the sheet member 82C is cut between the sheet member 82A and the sheet member 82B.

As materials for the sheet member 82A, the sheet member 82B, and the sheet member 82C, it is possible for each of, for example, polyethylene terephthalate (PET), nylon, polyethylene, or the like to be adopted. In addition, it is possible to also adopt a layered configuration where films which are configured using these materials are layered. In these layered configurations, it is possible for, for example, the outer layer to be PET or nylon which is superior in terms of shock resistance and the inner layer to be polyethylene which is superior in terms of resistance to ink. Furthermore, it is possible for films, which have a layer where aluminum or the like is deposited, and the like to be adopted. Due to this, it is possible to improve the gas barrier properties.

The flow path unit 83 is interposed using the sheet member 82A and the sheet member 82B at a portion of the peripheral edge region 85. The flow path unit 83 and the sheet member 82A are bonded to each other at a portion of the peripheral edge region 85. In the same manner, the flow path unit 83 and the sheet member 82B are bonded to each other at a portion of the peripheral edge region 85. For this reason, a portion of the peripheral edge region 85 where the flow path unit 83 is interposed using the sheet member 82A and the sheet member 82B is a joining section for the ink containing section 82 and the flow path unit 83. A bonding section 86 is provided in the flow path unit 83. Each of the sheet member 82A and the sheet member 82B are bonded to the bonding section 86 in a state where the bonding section 86 is interposed using the sheet member 82A and the sheet member 82B. The ink containing section 82 where the sheet member 82C is the bottom portion is configured due to the sheet member 82A, the sheet member 82B, and the flow path unit 83 being joined to each other.

Figure 4:
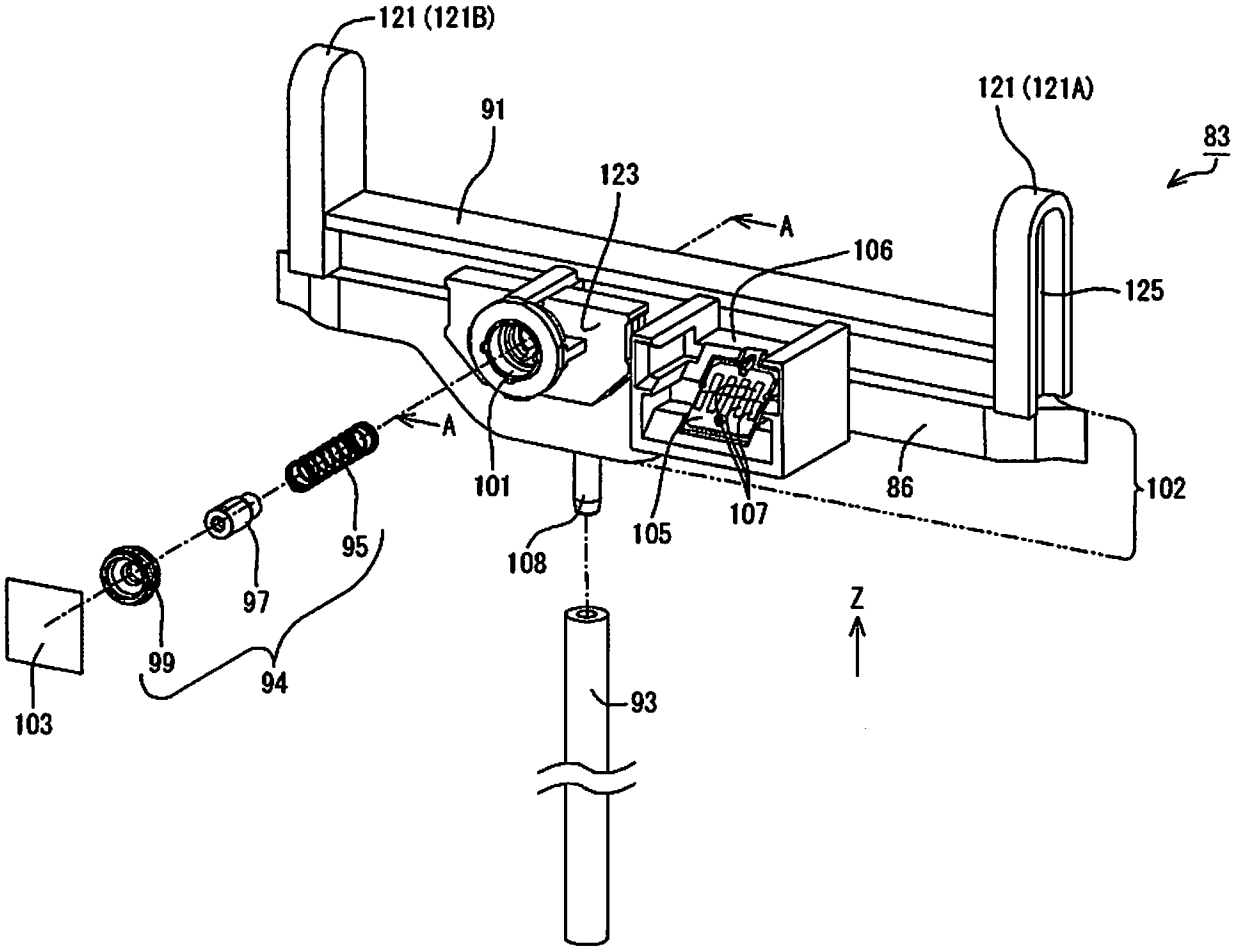
FIG. 4 is a perspective diagram illustrating a breakdown of a flow path unit in an embodiment of the present invention.

The flow path unit 83 has a base member 91, a tube 93, and a valve unit 94 as shown in FIG. 4. The valve unit 94 has a spring 95, a plug (valve body) 97, and a packing (valve seat) 99. An ink extraction section 101 which is one example of a liquid extraction section is provided in the base member 91. The base member 91 is positioned at an end section of the ink containing section 82. The base member 91 has a base section 102. The ink extraction section 101 is provided in the base section 102. The ink extraction section 101 protrudes from the base section 102 in a direction which intersects with the Z axis. The inner section of the ink containing section 82 (FIG. 3) and the outside communicate via the ink extraction section 101. The base member 91 protrudes more to the outer side than the ink containing section 82. The base member 91 has a function as a liquid extraction section where ink which is one example of a liquid is extracted from an inner section of the ink containing section 82 to the outside. The spring 95, the plug 97, and the packing 99 are contained inside the ink extraction section 101 in this order. The ink extraction section 101 is closed off using a film 103 in a state before the ink container 51 is mounted onto the ink supply apparatus 4. Due to this, an enclosed state is maintained in the inner section of the ink containing section 82.

In addition, a circuit substrate which is one example of a contact section is provided in the flow path unit 83. A substrate installation section 106 is provided in the base member 91. The substrate installation section 106 is provided in the base section 102. The substrate installation section 106 protrudes from the base section 102 in a direction which intersects with the Z axis. The substrate installation section 106 is provided on the ink extraction section 101 side of the base member 91. That is, the ink extraction section 101 and the substrate installation section 106 are provided on the same side of the base member 91. The circuit substrate 105 is provided in the substrate installation section 106. A plurality of terminal sections 107 are provided on the circuit substrate 105. The plurality of terminal sections 107 are provided on the opposite side to the base member 91 side. A memory apparatus (which is not shown in the diagram) such as a non-volatile memory is provided on the circuit substrate 105 on the opposite side to the terminal section 107 side. At least a portion of the plurality of terminal sections 107 are electrically connected with the memory apparatus.

In the base member 91, the side surface of the base section 102 is set as the bonding section 86. An introduction opening 108 is provided on the base member 91. The introduction opening 108 is provided in the base section 102 and extends along the Z axis. The introduction opening 108 protrudes from the base section 102 in the −Z axis direction. The introduction opening 108 communicates with the inside of the ink containing section 82 and ink inside of the ink containing section 82 is introduced to the ink extraction section 101. Here, the ink extraction section 101 extends in a direction which intersects with the extending direction of the introduction opening 108, that is, in a direction which intersects with the Z axis. The tube 93 is connected with the introduction opening 108. Then, the tube 93 is contained inside the ink containing section 82 as shown in FIG. 3. The introduction path to the introduction opening 108 is lengthened to extent to the far side of the ink containing section 82 using the tube 93.

The base member 91 has two rail sections 121 and an engagement section 123 as shown in FIG. 4. The two rail sections 121 are provided on the base section 102. The two rail sections 121 are provided on the Z axis direction side of the base section 102. The two rail sections 121 protrude from the base section 102 in the Z axis direction, that is, from the base section 102 toward the introduction opening 108 side of the base section 102, that is, toward the opposite side to the ink containing section 82 (FIG. 3) side. The two rail sections 121 oppose each other so as to interpose the ink extraction section 101 and the substrate installation section 106 in a planar view when the base member 91 is viewed from the ink extraction section 101 side. Grooves 125 are formed in each of the two rail sections 121. The grooves 125 extend along the Z axis. The grooves 125 are formed with an orientation so as to be recessed from the rail sections 121 toward the ink extraction section 101 side. Below, the two rail sections 121 are each labelled as the rail section 121A and the rail section 121B in a case where the two rail sections 121 are to be individually identified.

The engagement section 123 is provided on the ink extraction section 101. The engagement section 123 has a plate shape and projects to the outer side of the ink extraction section 101. For this reason, the engagement section 123 has a flange shape which projects to the outer side of the ink extraction section 101. The engagement section 123 projects from the ink extraction section 101 toward both the rail section 121A side and the rail section 121B side. That is, the engagement section 123 projects more toward the rail section 121A side than the ink extraction section 101. In addition, the engagement section 123 projects more toward the rail section 121B side than the ink extraction section 101. The engagement section 123 is separated from the base section 102. That is, there is a gap between the engagement section 123 and the base section 102.

Figure 5:
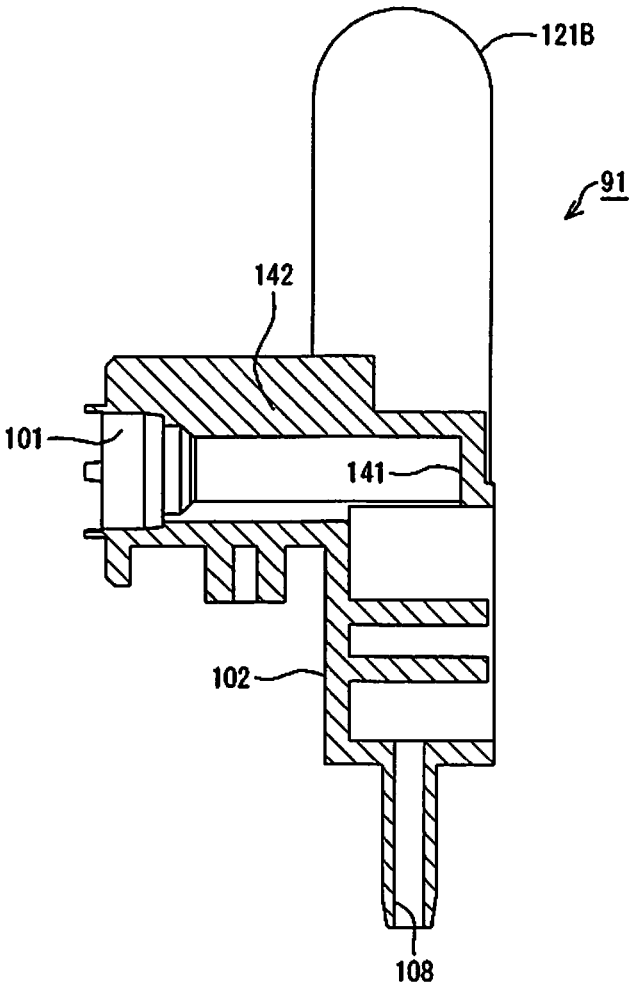
FIG. 5 is a cross sectional diagram when a base member in an embodiment of the present invention is cut along line A-A in FIG. 4.
Figure 6:
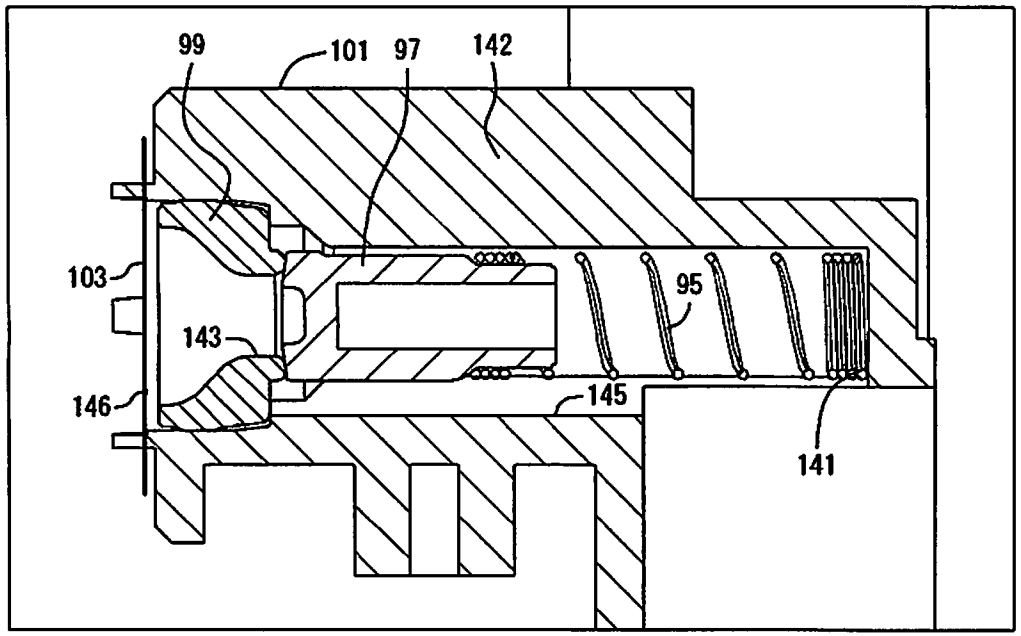
FIG. 6 is an enlarged cross sectional diagram when a flow path unit in an embodiment of the present invention is cut along line A-A in FIG. 4.

The ink extraction section 101 communicates with the introduction opening 108 in an inner section of the base member 91 as shown in FIG. 5 which is a cross sectional diagram when the base member 91 is cut along line A-A in FIG. 4. The ink extraction section 101 has a bottom section 141 and a side wall 142. The side wall 142 surrounds the bottom section 141. The region which is surrounded by the side wall 142 has a function as a supply opening for supplying ink inside the ink containing section 82 to the outside. The spring 95, the plug 97, and the packing 99 are contained on the inner side of the ink extraction section 101 as shown in FIG. 6. The spring 95 is interposed by the bottom section 141 of the ink extraction section 101 and the plug 97. The plug 97 is interposed by the spring 95 and the packing 99. For this reason, the plug 97 is pressed by the spring 95 toward the packing 99 side.

The packing 99 is configured using, for example, an elastic body such as with rubber or an elastomer. The packing 99 is pressed into the inside of the ink extraction section 101. An opening section 143 is provided in the packing 99. The plug 97 is pressed toward the packing 99 side in a state of overlapping with the opening section 143 of the packing 99. For this reason, the opening section 143 of the packing 99 is closed off using the plug 97. A gap is maintained between the plug 97 and the ink extraction section 101. In addition, a gap is maintained between the spring 95 and the ink extraction section 101. For this reason, it is possible for each of the plug 97 and the spring 95 to shift the inner section of the ink extraction section 101 along the extending direction of the ink extraction section 101.

Here, a groove 145 is provided on the inner side of the ink extraction section 101. The groove 145 extends from a terminal end 146 side of the ink extraction section 101 toward the bottom section 141 along the extending direction of the ink extraction section 101. The groove 145 reaches from the bottom section 141 more to the packing 99 side than the spring 95. The groove 145 is provided with an orientation so as to be recessed from the inner wall of the ink extraction section 101 toward the outer wall of the ink extraction section 101. For this reason, it is possible to utilize the space which is surrounded by the plug 97 and the groove 145 as a flow path for ink in a state where the plug 97 is contained inside the ink extraction section 101.

Figure 7:
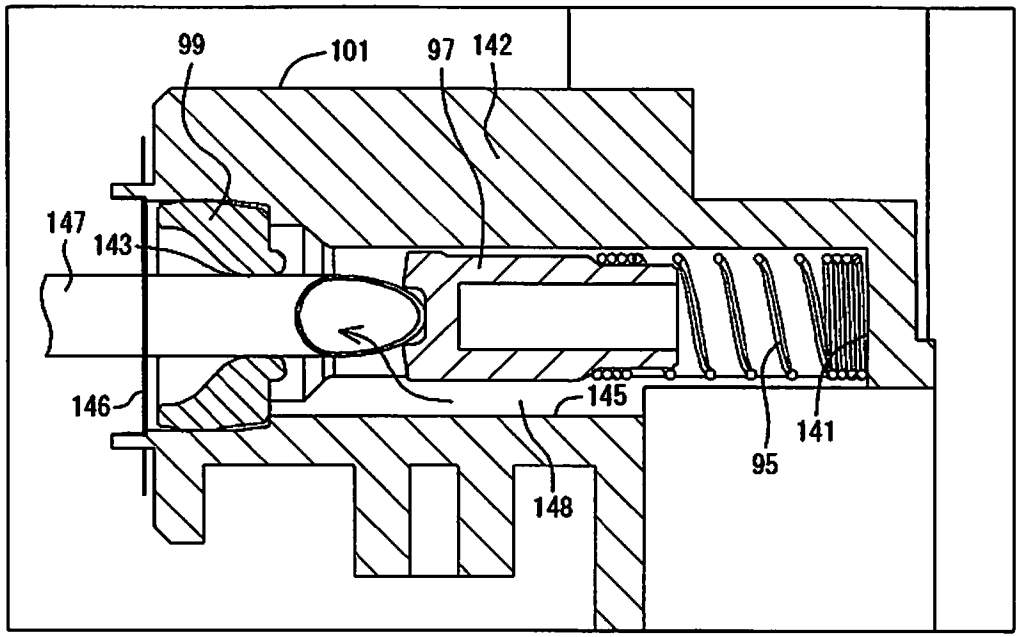
FIG. 7 is an enlarged cross sectional diagram when a flow path unit in an embodiment of the present invention is cut along line A-A in FIG. 4.

When the ink container 51 is mounted on the ink supply apparatus 4 (FIG. 1), a supply needle 147 is inserted into the opening section 143 of the packing 99 as shown in FIG. 7. At this time, the plug 97 is shifted towards the bottom section 141 side due to being pushed by the supply needle 147. The supply needle 147 is formed to be hollow. In addition, the supply needle 147 communicates with the ink supply tube 57. Due to this, it is possible to supply ink to the ink supply tube 57 (FIG. 1) from a flow path 148 which is surrounded by the groove 145 and the plug 97 via the supply needle 147 as shown by the arrow in the diagram. Here, the supply needle 147 is provided inside the case 53 of the ink supply apparatus 4.

Figure 8:
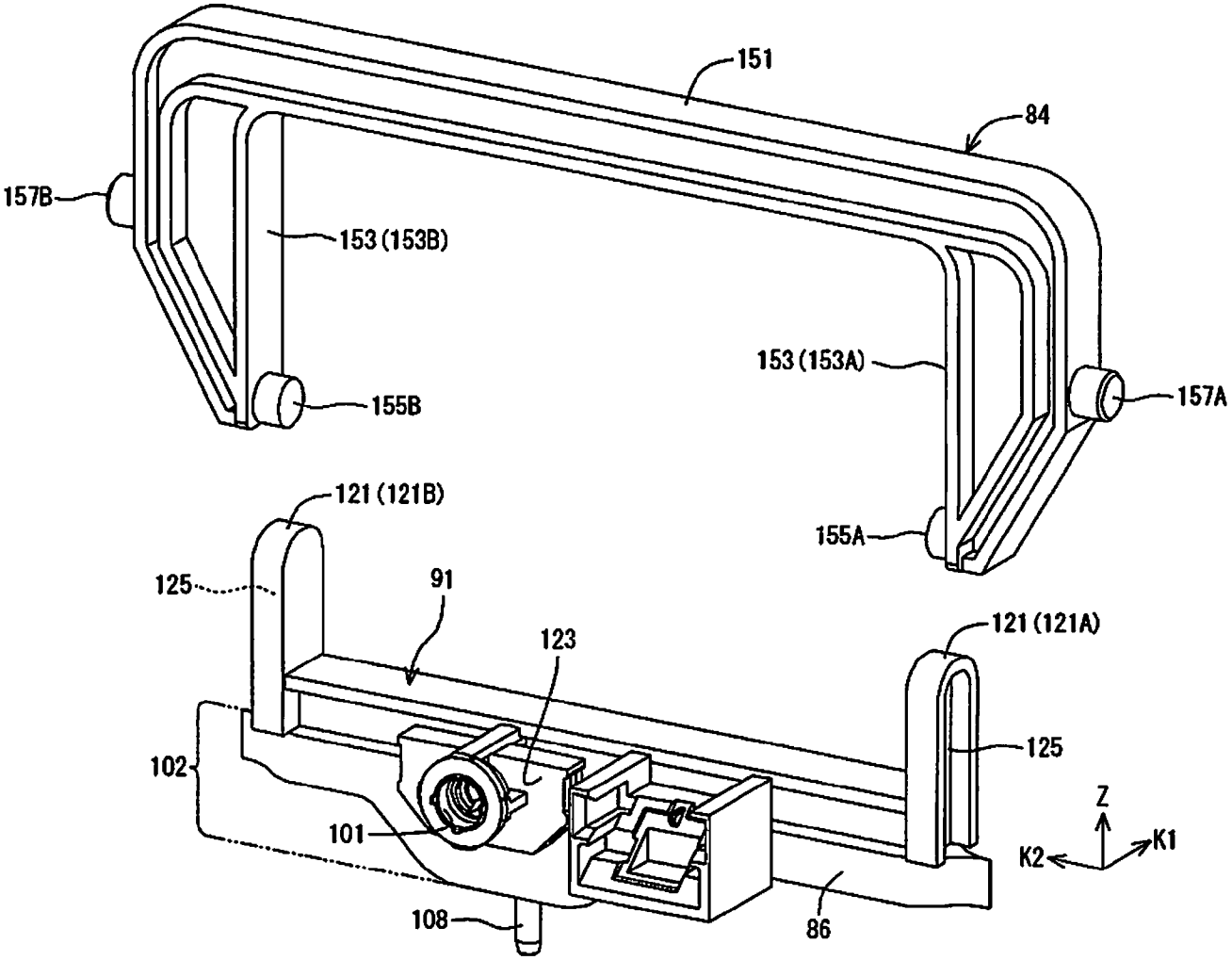
FIG. 8 is a perspective diagram illustrating a breakdown of a base member and a handle in an embodiment of the present invention.

The handle 84 is provided on the base member 91 more to the Z axis direction side than the base section 102 as shown in FIG. 8. The handle 84 is configured to be a separate body to the base member 91. The handle 84 has a grip section 151 and two leg sections 153. The grip section 151 extends along the base section 102 of the base member 91. The two leg sections 153 are provided on the grip section 151. The two leg sections 153 protrude from the grip section 151. The two leg sections 153 protrude toward a direction which intersects with the extending direction of the grip section 151. In FIG. 8, the two leg sections 153 extend along the extending direction of the introduction opening 108 of the base member 91, that is, along the Z axis direction. Below, the two leg sections 153 are each labelled as the leg section 153A and the leg section 153B in a case where the two leg sections 153 are to be individually identified.

An engagement section 155A and a protruding section 157A are formed in the leg section 153A. An engagement section 155B and a protruding section 157B are formed in the leg section 153B. The engagement section 155A is provided on the leg section 153B side of the leg section 153A. The engagement section 155A is provided on the leg section 153A at the tip end side which is opposite to the grip section 151 side. The engagement section 155A protrudes from the leg section 153A. The engagement section 155A protrudes from the leg section 153A toward the leg section 153B side. The protruding section 157A is provided on the opposite side to the engagement section 155A side of the leg section 153A. The protruding section 157A is provided more to the grip section 151 side than the engagement section 155A. In the leg section 153A, the protruding section 157A is positioned between the grip section 151 and the engagement section 155A. The protruding section 157A protrudes from the leg section 153A. The protruding section 157A protrudes from the leg section 153A toward the opposite side to the leg section 153B side. Here, the protruding section 157A and the protruding section 157B are one example of a first engagement section, the engagement section 155A and the engagement section 155B are one example of a second engagement section, and the engagement section 123 is one example of a third engagement section.

The engagement section 155B is provided on the leg section 153A side of the leg section 153B. The engagement section 155B is provided on the leg section 153B at the tip end side which is opposite to the grip section 151 side. The engagement section 155B protrudes from the leg section 153B. The engagement section 155B protrudes from the leg section 153B toward the leg section 153A side. The protruding section 157B is provided on the opposite side to the engagement section 155B side of the leg section 153B. The protruding section 157B is provided more to the grip section 151 side than the engagement section 155B. In the leg section 153B, the protruding section 157B is positioned between the grip section 151 and the engagement section 155B. The protruding section 157B protrudes from the leg section 153B. The protruding section 157B protrudes from the leg section 153B toward the opposite side to the leg section 153A side. The engagement section 155A and the engagement section 155B are opposed to each other.

The grip section 151 is longer than the base section 102 of the base member 91 in the direction in which the grip section 151 extends. Then, the two leg sections 153 are positioned more to the outer side than the two rail sections 121 of the base member 91. For this reason, it is possible for the two leg sections 153 to interpose the two rail sections 121 of the base member 91. In other words, the two rail sections 121 of the base member 91 fit between the two leg sections 153. At this time, the engagement section 155A of the handle 84 engages with the inside of the groove 125 of the rail section 121A. In addition, the engagement section 155E of the handle 84 engages with the inside of the groove 125 of the rail section 121B. Due to this, it is possible for an operator to insert a finger between the grip section 151 and the base section 102 and to grip the grip section 151. Then, it is possible for an operator to hold the ink container 51 so as to hang down in a state where the grip section 151 is gripped.

Here, the engagement section 155A and the engagement section 155B are each set with dimensions such that insertion inside the grooves 125 is possible. Due to this, the handle 84 is assembled so as to be able to be rotated with regard to the base member 91 with the engagement section 155A and the engagement section 155B as pivots. Furthermore, the handle 84 is configured so as to be able to move with regard to the base member 91 along the groove 125 in a state of being engaged with the base member 91 since the grooves 125 of the two rail sections 121 extend along the Z axis. Here, the grooves 125 are one example of an engagement target section which is able to slide with the second engagement section.

An attaching and detaching unit 171 which is provided in the ink supply apparatus 4 will be described. The attaching and detaching unit 171 includes a mechanism for the ink container 51 to be attached to and detached from the ink supply apparatus 4. The number of the attaching and detaching units 171 which are provided in the ink supply apparatus 4 is the same as the number of the ink containers 51 which are able to be mounted onto the ink supply apparatus 4. That is, the attaching and detaching unit 171 is provided for each of the ink containers 51 which are mounted in the ink supply apparatus 4. The attaching and detaching unit 171 has a holder 172, an ink introduction section 173, a contact point mechanism 175 which is one example of an electrical connection, a moveable member 177, and two support members 181. The holder 172 is a member which supports the attaching and detaching unit 171. The ink introduction section 173 and the contact point mechanism 175 are provided inside the holder 172. As a format for fixing the holder 172, there may be a format of being directly fixed to the printer 3 or a format of being fixed to the printer 3 via the case 53 of the ink supply apparatus 4.

The ink introduction section 173 which is one example of a connection section has the supply needle 147 which is described above. The ink introduction section 173 has a function as a liquid introduction section for introducing ink, which is extracted from inside of the ink containing section 82 of the ink container 51 via the ink extraction section 101, to the relay apparatus 9. The supply needle 147 communicates with the ink supply tube 57. Here, in the ink supply apparatus 4, the direction in which the supply needle 147 extends is set as a K1 direction. In the ink supply apparatus 4, the Z axis direction is the same as the Z axis direction in the liquid ejecting system 1. Then, the direction which intersects with both the K1 direction and the Z axis direction is set as a K2 direction. Using this definition, the ink extraction section 101 extends along the K1 direction and the base section 102 extends along the K2 direction in the base member 91 of the ink container 51 in the ink supply apparatus 4 as shown in FIG. 8. In the same manner, the grip section 151 also extends in the K2 direction.

The contact point mechanism 175 is a connection section which is electrically connected with the circuit substrate 105 of the ink container 51. At least a portion of the plurality of terminal sections 107 (FIG. 4) of the circuit substrate 105 come into contact with the contact point mechanism 175 in a state where the ink container 51 is mounted in the attaching and detaching unit 171. The contact point mechanism 175 is electrically connected with the control section 11 via the flexible cable 31 (FIG. 1). Then, due to the contact point mechanism 175 and the memory apparatus (which is not shown in the diagrams) of the ink container 51 being electrically joined up via the circuit substrate 105, transfer of various types of information is possible between the control section 11 and the memory apparatus of the ink container 51.

The moveable member 177 is configured so as to be able to advance and retreat with regard to the holder 172 along the K1 direction. The moveable member 177 is provided at a position which overlaps with the ink introduction section 173 when the attaching and detaching unit 171 is viewed from the K1 direction and moves across a region which spans between the ink introduction section 173 and the contact point mechanism 175 in the K2 direction. A support section 183 is provided in the moveable member 177. The support section 183 is provided at a position which overlaps with the ink introduction section 173 when the attaching and detaching unit 171 is viewed from the K1 direction. A notch section 185 is provided in the support section 183 at a location which overlaps with the supply needle 147. For this reason, it is possible for the supply needle 147 of the ink introduction section 173 to be inserted in the notch section 185 of the support section 183 when the moveable member 177 is moved toward the ink introduction section 173 along the opposite direction to the K1 direction. Here, the support section 183 is one example of a first support section.

Figure 10:
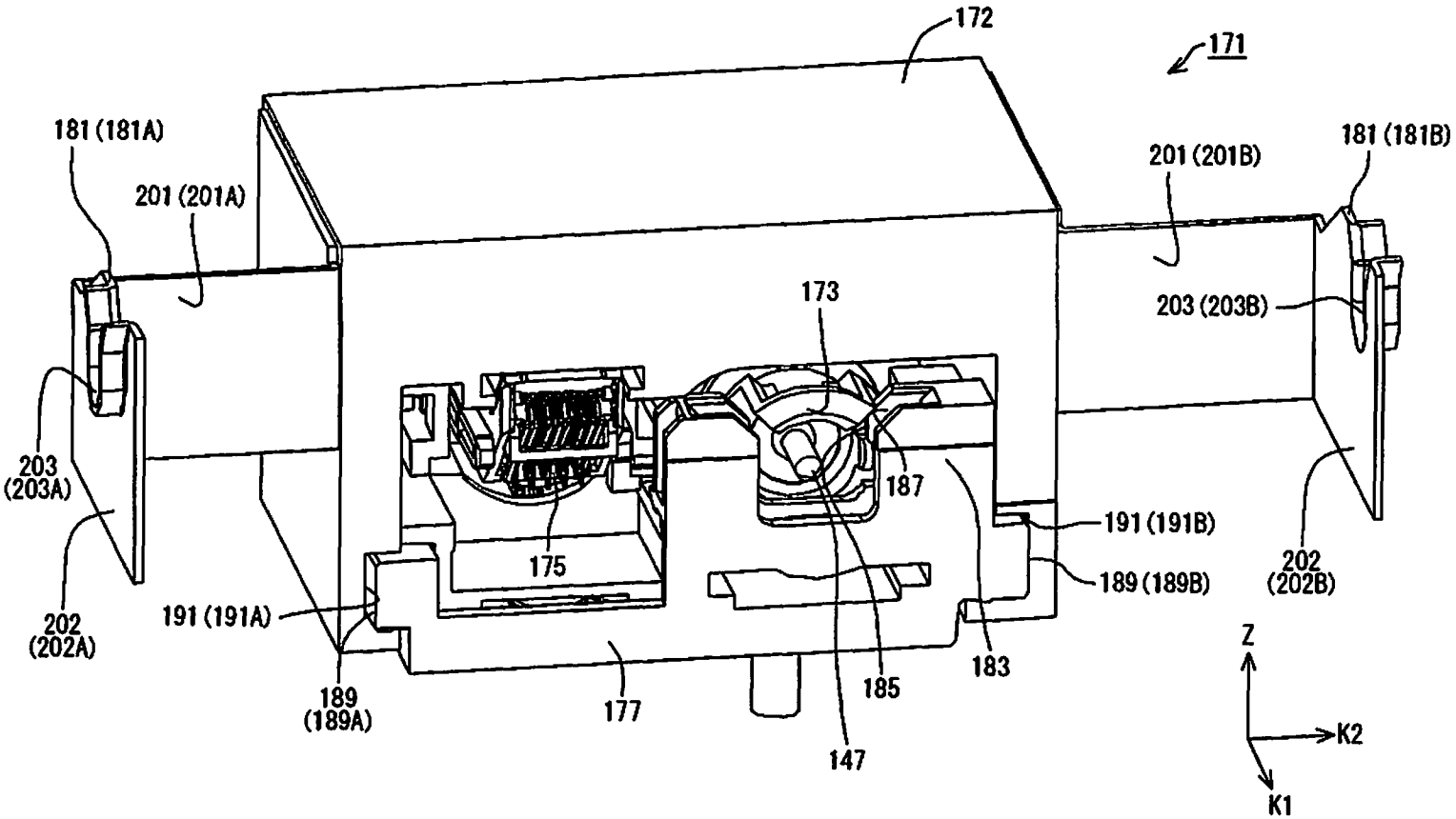
FIG. 10 is a perspective diagram illustrating an attaching and detaching unit in an embodiment of the present invention.

A recess section 187 is provided in the support section 183. In the support section 183, the recess section 187 is provided with an orientation so as to be recessed toward the −Z axis direction. The recess section 187 is provided over a region which spans the notch section 185 in the K2 direction. For this reason, it is possible for the supply needle 147 to enter inside of the recess section 187 via the notch section 185 of the support section 183 when the moveable member 177 is moved toward the ink introduction section 173 along the opposite direction to the K1 direction as shown in FIG. 10. It is possible for the engagement section 123 (FIG. 8) which is provided on the base member 91 of the ink container 51 to be inserted inside the recess section 187. It is possible for the engagement section 123 of the ink container 51 to be inserted from the Z axis direction side of the recess section 187 into the inside of the recess section 187 in a state where the ink extraction section 101 of the ink container 51 faces towards the ink introduction section 173 side of the attaching and detaching unit 171.

Figure 9:
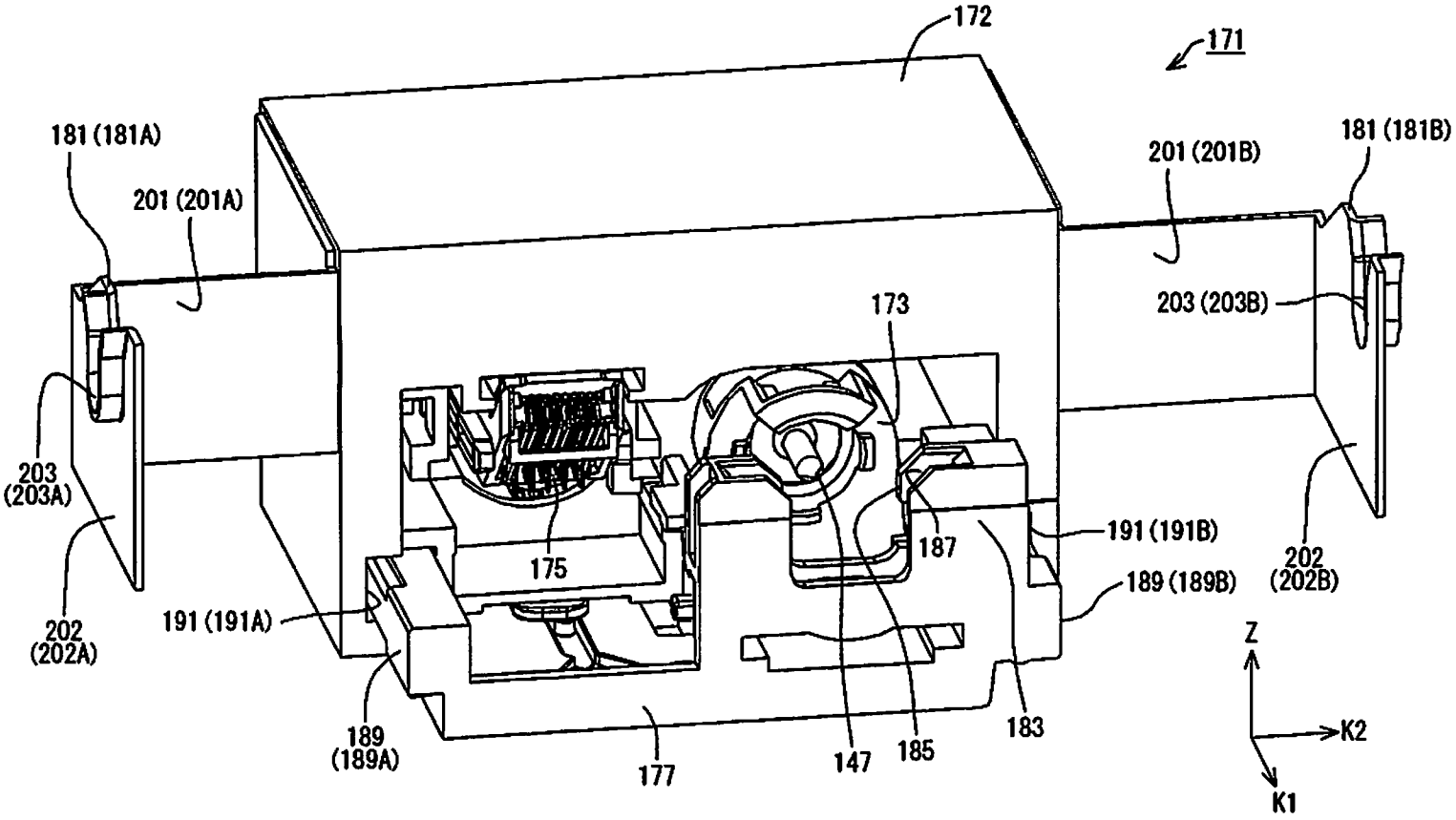
FIG. 9 is a perspective diagram illustrating an attaching and detaching unit in an embodiment of the present invention.

In addition, two slide sections 189 are provided in the moveable member 177 as shown in FIG. 9. Each of the two slide sections 189 extend along the K1 direction. The two slide sections 189 are provided at positions which branch off from each other so as to interpose the ink introduction section 173 and the contact point mechanism 175 in the K2 direction when the attaching and detaching unit 171 is viewed from the K1 direction. In the present embodiment, each of the two slide sections 189 are provided more to the outer side than the support section 183 when the attaching and detaching unit 171 is viewed from the K1 direction. Below, the two slide sections 189 are each labelled as the slide section 189A and the slide section 189B in a case where the two slide sections 189 are to be individually identified. The slide section 189A is positioned more to the contact point mechanism 175 side than the supply needle 147 of the ink introduction section 173, that is, further in the −K2 direction than the supply needle 147 when the attaching and detaching unit 171 is viewed from the K1 direction. In addition, the slide section 189B is positioned more to the opposite side to the slide section 189A side than the notch section 185, that is, further in the K2 direction than the notch section 185 when the attaching and detaching unit 171 is viewed from the K1 direction.

Two guide sections 191 are formed in the holder 172 at positions which overlap with the two slide sections 189 with the holder 172 being viewed from the K1 direction. Below, the two guide sections 191 are each labelled as the guide section 191A and the guide section 191B in a case where the two guide sections 191 are to be individually identified. At this time, the guide section 191A corresponds to the slide section 189A and the guide section 191B corresponds to the slide section 189B.

The guide section 191A and the guide section 191B are configured so as to be able to be respectively inserted in the slide section 189A and the slide section 189B. That is, it is possible for the slide section 189A to be inserted in the guide section 191A and it is possible for the slide section 189B to be inserted in the guide section 191B. The guide section 191A and the guide section 191B respectively guide the slide section 189A and the slide section 189B in the K1 direction and in the opposite direction to the K1 direction. Due to this, the moveable member 177 is configured to be able to advance and retreat with regard to the holder 172 along the K1 direction. Here, the moveable member 177 is pressed in the k1 direction with regard to the holder 172. For this reason, the moveable member 177 is shifted toward the ink introduction side as shown in FIG. 10 when the force in the opposite direction to the K1 direction acts on the moveable member 177.

The two support members 181 line up in the K2 direction so as to interpose the holder 172 as shown in FIG. 9. The two support members 181 are each fixed to the holder 172. Below, the two support members 181 are each labelled as the support member 181A and the support member 181B in a case where the two support members 181 are to be individually identified. The support member 181A is provided in the −K2 direction of the holder 172. The support member 181B is provided in the K2 direction of the holder 172.

The support members 181 have a leg section 201 and a support section 202. Here, the support sections 202 are one example of a second support section. Below, in the two support members 181, the leg section 201 of the support member 181A is labelled as the leg section 201A and the leg section 201 of the support member 181B is labelled as the leg section 201B in a case where the leg sections 201 are to be identified for each of the support members 181. In the same manner, in the two support members 181, the support section 202 of the support member 181A is labelled as the support section 202A and the support section 202 of the support member 181B is labelled as the support section 202B in a case where the support sections 202 are to be identified for each of the support members 181.

In the support member 181A, the leg section 201A protrudes from the holder 172 in the −K2 direction. The support section 202A protrudes from the leg section 201A in the K1 direction. In addition, in the support member 181B, the leg section 201B protrudes from the holder 172 in the K2 direction. The support section 202B protrudes from the leg section 201B in the K1 direction. The support section 202A and the support section 202B each protrudes more to the K1 direction side than the holder 172. The support section 202A and the support section 202B oppose each other so as to interpose the holder 172. At least a portion of each of the support section 202A and the support section 202B protrudes more to the Z axis direction side than the moveable member 177 when the attaching and detaching unit 171 is viewed from the K1 direction.

A receiving section 203 is formed in the support section 202. The receiving section 203 has a format where a portion of the support section 202 with a plate shape is cut out. The receiving section 203 is formed on the Z axis direction side of the support section 202 and is formed with an orientation so as to be recessed toward the −Z axis direction. Below, the receiving section 203 of the support member 181A is labelled as the receiving section 203A and the receiving section 203 of the support member 181B is labelled as the receiving section 203B in a case where the receiving section 203 of the support member 181A and the receiving section 203 of the support member 181B are to be are to be individually identified. The receiving section 203A and the receiving section 203B line up along the K2 direction.

The receiving section 203 is configured so that it is possible for the protruding section 157 (FIG. 8) of the handle 84 to be inserted. Here, it is possible for the protruding section 157A of the handle 84 to be inserted into the receiving section 203A from the Z axis direction side of the receiving section 203A. In the same manner, it is possible for the protruding section 157B of the handle 84 to be inserted into the receiving section 203B from the Z axis direction side of the receiving section 203B. Then, it is possible for the handle 84 to be rotated with the protruding section 157A and the protruding section 157B as pivots in a state where the protruding section 157A of the handle 84 is inserted in the receiving section 203A and the protruding section 157B of the handle 84 is inserted in the receiving section 203B. Here, in the present embodiment, the support section 202 is fixed to the holder 172, but the format for fixing the support section 202 is not limited to this. As the format for fixing the support section 202, there may be a format where the support section 202 is directly fixed to the printer 3 or a format where the support section 202 is fixed to the case 53 of the ink supply apparatus 4.

Figure 11:
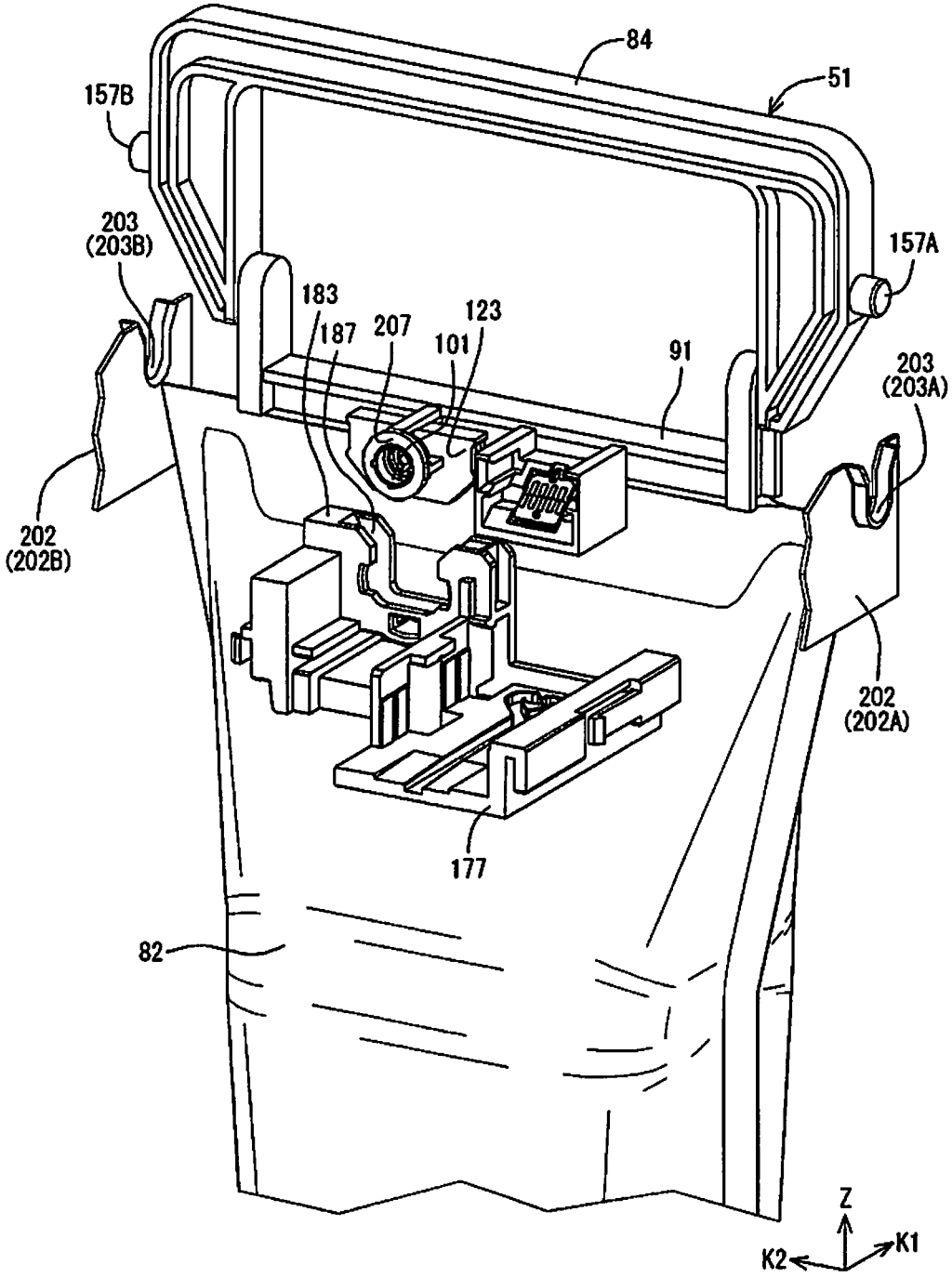
FIG. 11 is a diagram for explaining the flow of mounting an ink container onto an attaching and detaching unit in an embodiment of the present invention.

The flow for mounting the ink container 51 onto the attaching and detaching unit 171 will be described. Firstly, the engagement section 123 of the ink container 51 is positioned on the Z axis direction side of the recess section 187 of the moveable member 177 in a state where the ink extraction section 101 of the ink container 51 faces toward the ink introduction section 173 side of the attaching and detaching unit 171 as shown in FIG. 11. At this time, it is possible for an operator to easily position the engagement section 123 on the Z axis direction side of the recess section 187 of the moveable member 177 due to the ink container 51 being supported by the handle 84 of the ink container 51 being gripped. Here, illustration of the holder 172, the ink introduction section 173, the contact point mechanism 175, and a portion of the support member 181 in the attaching and detaching unit 171 are omitted in FIG. 11 so that the configuration is easy to understand.

Here, the end surface 207 of the ink extraction section 101 faces toward the −K1 direction which intersects with the Z axis direction which is the protruding direction of the handle 84 from the base member 91 when the ink container 51 is supported by an operator gripping the handle 84 and the handle 84 protrudes more to the opposite side to the ink containing section 82 than the base member 91, that is, in the Z axis direction. For this reason, it is easy for the ink extraction section 101 to be visually confirmed and it is possible for mounting onto the attaching and detaching unit 171 to be performed while taking into consideration the end surface 207 of the liquid extraction section 101 since it is difficult for the end surface 207 of the liquid extraction section 101 to overlap with the handle 84 in the line of sight of an operator when the ink container 51 is supported by an operator gripping the handle 84. Due to this, it is possible for an operator to easily position the engagement section 123 on the Z axis direction side of the recess section 187 of the moveable member 177. Here, at this time, the protruding section 157A and the protruding section 157B of the handle 84 are respectively positioned on the Z axis direction sides of the receiving section 203A and the receiving section 203B.

Figure 12:
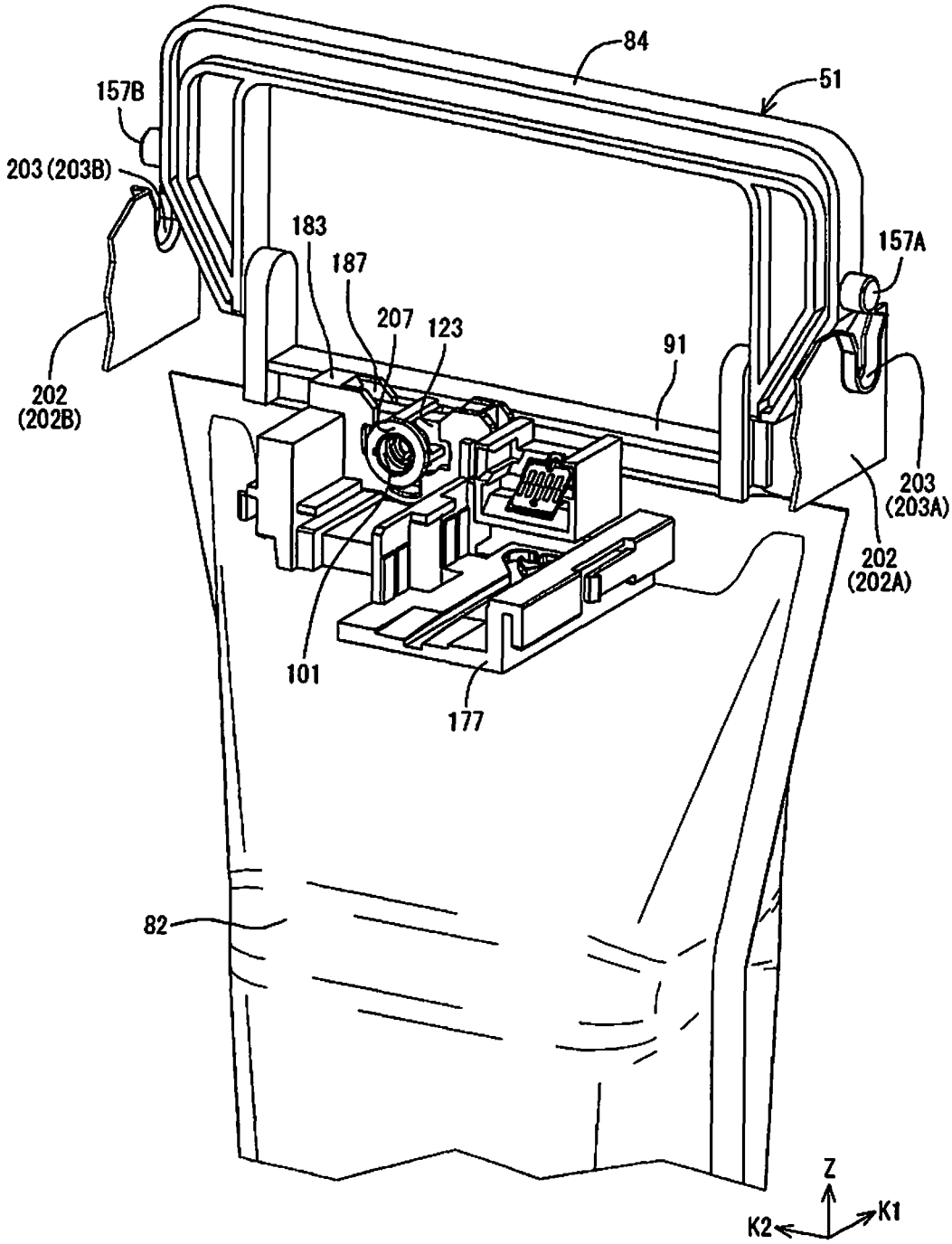
FIG. 12 is a diagram for explaining the flow of mounting an ink container onto an attaching and detaching unit in an embodiment of the present invention.

Next, the engagement section 123 engages with the inside of the recess section 187 of the moveable member 177 due to the ink container 51 being lowered in the −Z axis direction as shown in FIG. 12. Due to this, the ink containing section 82 is supported by the attaching and detaching unit 171 via the base member 91. Due to this, the ink container 51 is in a state of hanging down due to the engagement section 123 being supported by the support section 183. At this time, the protruding section 157A and the protruding section 157B of the handle 84 are respectively positioned on the Z axis direction sides of the receiving section 203A and the receiving section 203B in a state where an operator is supporting the handle 84 in the Z axis direction. The ink containing section 82 is supported by the attaching and detaching unit 171 via the base member 91 due to the engagement section 123 engaging with the inside of the recess section 187 of the moveable member 177. Due to this, an operator is freed from the weight of the ink container 51 when the engagement section 123 engages with the inside of the recess section 187 from the Z axis direction side of the recess section 187. For this reason, it is easy for the ink container 51 to be attached to and detached from the attaching and detaching unit 171 due to the engagement section 123 engaging with the inside of the recess section 187 of the moveable member 177. Here, illustration of the holder 172, the ink introduction section 173, the contact point mechanism 175, and a portion of the support member 181 in the attaching and detaching unit 171 are omitted in FIG. 12 so that the configuration is easy to understand.

Figure 13:
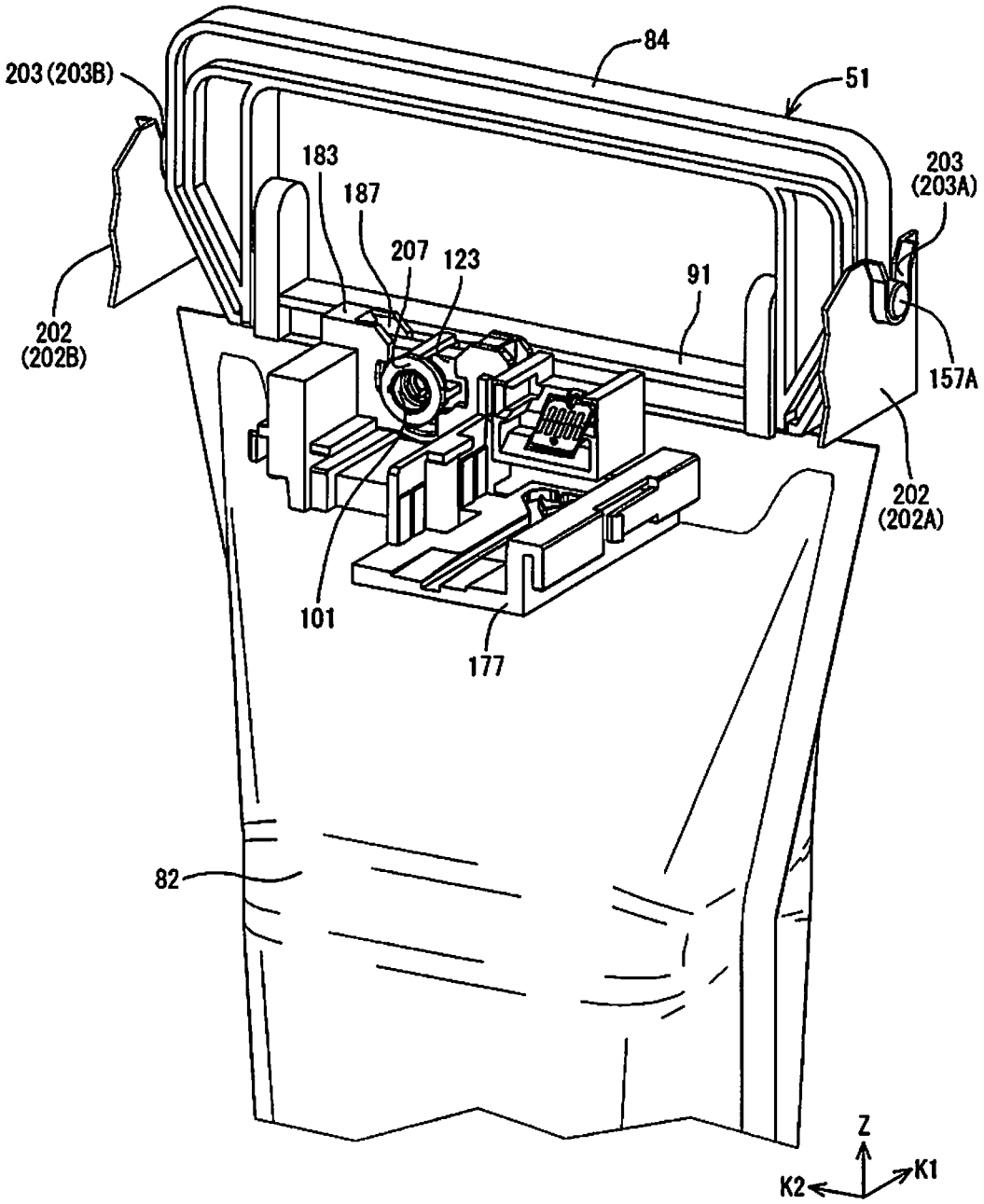
FIG. 13 is a diagram for explaining the flow of mounting an ink container onto an attaching and detaching unit in an embodiment of the present invention.
Figure 14:
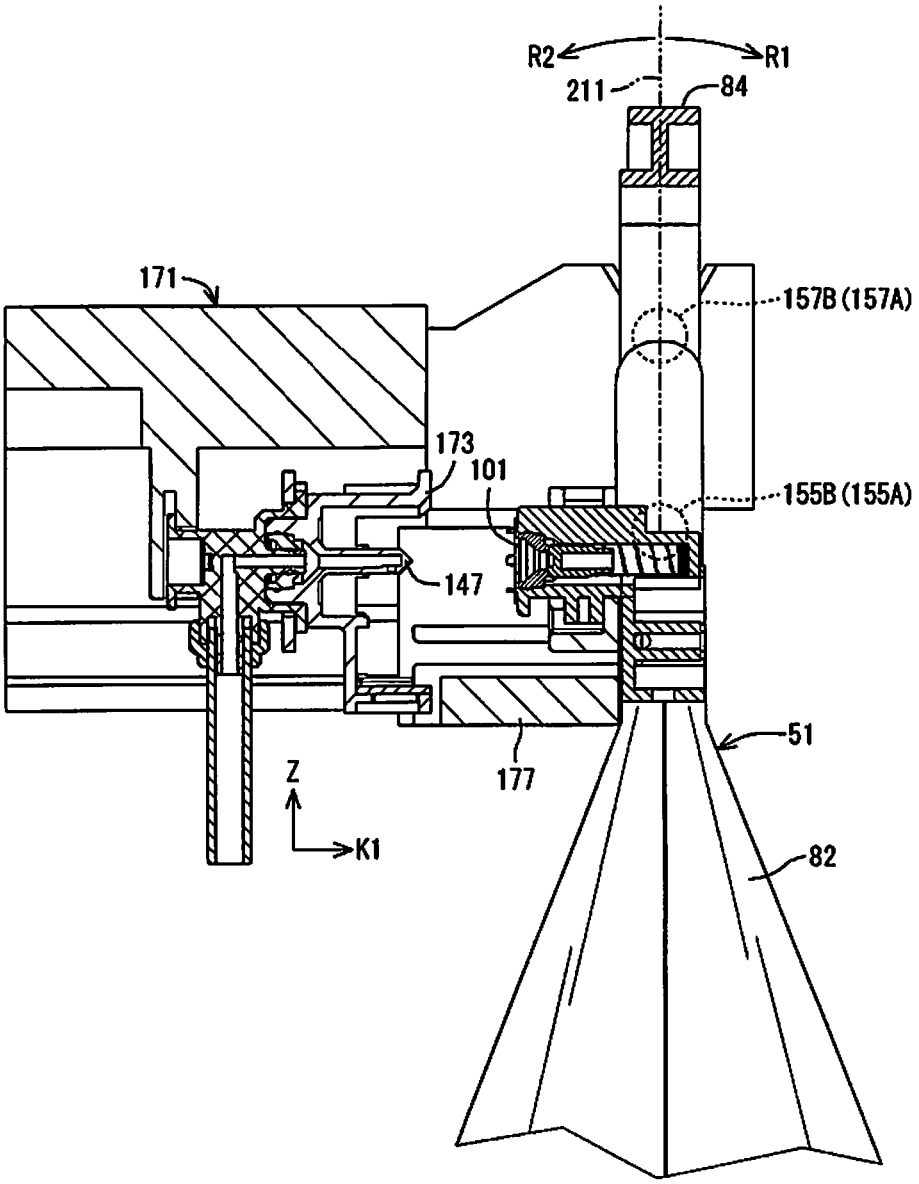
FIG. 14 is a diagram for explaining the flow of mounting an ink container onto an attaching and detaching unit in an embodiment of the present invention.

Next, it is possible for the protruding section 157A and the protruding section 157B to respectively engage with the receiving section 203A and the receiving section 203B due to the handle 84 being lowered in the −Z axis direction as shown in FIG. 13. The state of the ink container 51 with regard to the attaching and detaching unit 171 at this time is a first state. The ink extraction section 101 and the ink introduction section 173 are separated from each other in the first state as shown in FIG. 14. That is, connection between the ink extraction section 101 and the ink introduction section 173 is released in the first state. The handle 84 is along a first hypothetical plane 211 in the first state. The first hypothetical plane 211 is a plane which is regulated by the Z axis direction and the K2 direction and which intersects with the K1 direction. Here, illustration of the holder 172, the ink introduction section 173, the contact point mechanism 175, and a portion of the support member 181 in the attaching and detaching unit 171 are omitted in FIG. 13 so that the configuration is easy to understand.

Here, the K1 direction, in which the ink introduction section 173 of the attaching and detaching unit 171 and the ink extraction section 101 of the ink container 51 line up, is set as a first direction as shown in FIG. 14. Then, the positions of the protruding section 157A and the protruding section 157B of the handle 84 are respectively higher than the positions of the engagement section 155A and the engagement section 155B in a state where connection between the ink introduction section 173 and the ink extraction section 101 is released. Here, a cross section, when the attaching and detaching unit 171 and the ink container 51 are cut along a position which is equivalent to the line A-A in FIG. 4, is shown in FIG. 14.

Figure 15:
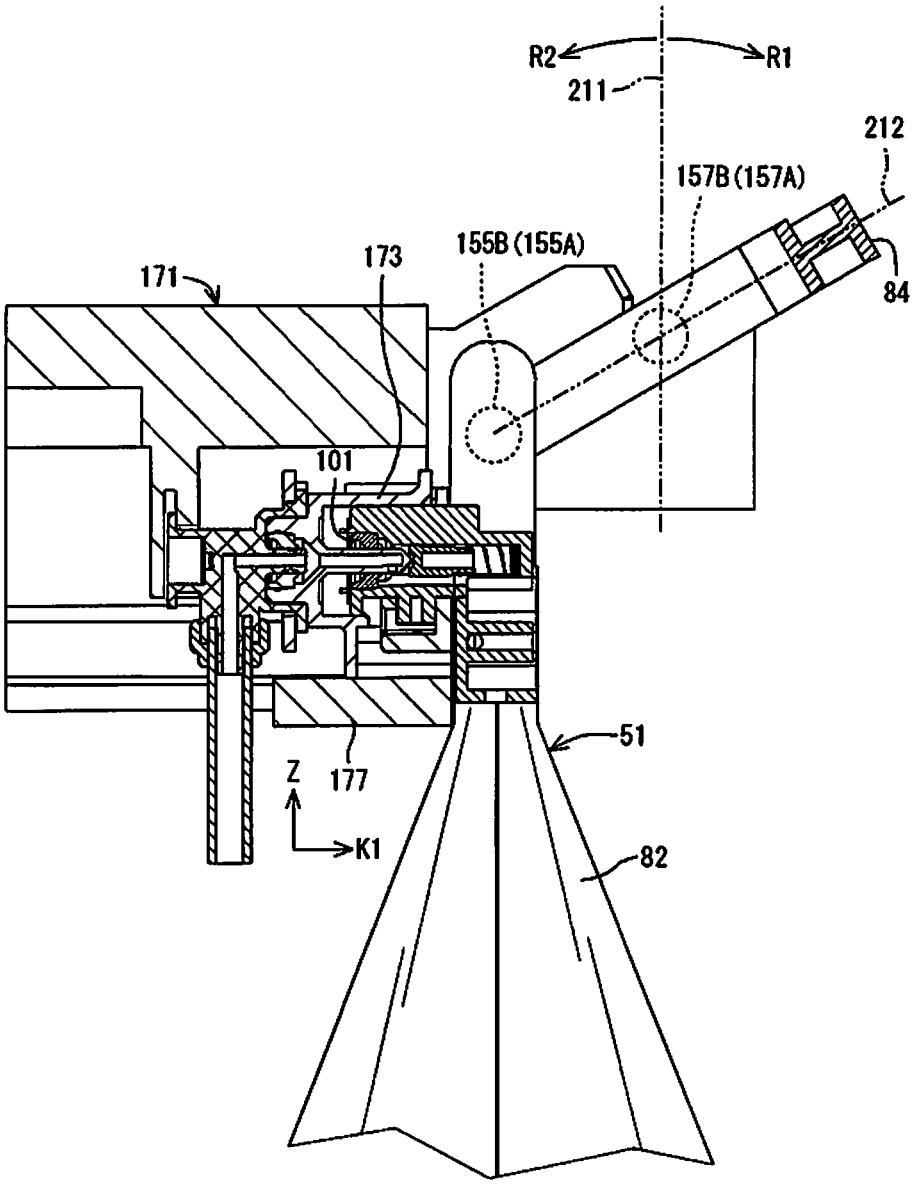
FIG. 15 is a diagram for explaining the flow of mounting an ink container onto an attaching and detaching unit in an embodiment of the present invention.

For this reason, the moveable member 177 is shifted in the −K1 direction as shown in FIG. 15 when the handle 84 is rotated in a first rotation direction R1 which is shown in FIG.

14 with the protruding section 157A and the protruding section 157B which are engaged with the receiving section 203A and the receiving section 203B (FIG. 13) as pivots. That is, it is possible to move the end surface 207 (FIG. 11) of the ink extraction section 101 in a direction (the −K1 direction) so as to face toward the end surface 207 by the handle 84 being rotated. For this reason, it is possible to change the distance between the ink extraction section 101 and the ink introduction section 173 in the first direction (the K1 direction). Due to this, it is possible to easily perform connection with the ink introduction section 173 which is positioned at the destination to which the ink extraction section 101 will be moved. Here, a cross section, when the attaching and detaching unit 171 and the ink container 51 are cut along a position which is equivalent to the line A-A in FIG. 4, is shown in FIG. 15.

The state of the ink container 51 with regard to the attaching and detaching unit 171 when the ink extraction section 101 and the ink introduction section 173 are connected to each other is a second state. The ink extraction section 101 and the ink introduction section 173 are connected to each other in the second state as shown in FIG. 15. The handle 84 is along a second hypothetical plane 212 in the second state. The second hypothetical plane 212 is a plane which intersects with both the Z axis direction and with the K1 direction. Then, the connection between the ink extraction section 101 and the ink introduction section 173 is released as shown in FIG. 14 when the handle 84 is rotated from the second state in a second rotation direction R2 with the protruding section 157A and the protruding section 157B which are engaged with the receiving section 203A and the receiving section 203B (FIG. 13) as pivots. The second rotation direction R2 is a direction which is opposite to the first rotation direction R1.

In the present embodiment, it is possible for an operator to hold the ink container 51 so as to hang down by an operator gripping the grip section 151 due to the ink container 51 having the handle 84. Due to this, it is easy for the ink container 51 to be attached to and detached from the ink supply apparatus 4 since it is easy for the ink container 51 to be moved. In addition, in the present embodiment, it is possible for the ink extraction section 101 and the ink introduction section 173 to be connected and for connection between the ink extraction section 101 and the ink introduction section 173 to be released by the handle 84 being rotated. Due to this, it is easy for the ink container 51 to be attached to and detached from the liquid supply apparatus 4.

In addition, in the present embodiment, the ink container 51 has the circuit substrate 105. The contact point mechanism 175 and the circuit substrate 105 line up with each other in the K1 direction when the engagement section 123 of the ink container 51 is supported by the support section 183 of the moveable member 177. Then, connection is easy since connection between the liquid extraction section 101 and the liquid introduction section 173 is possible and connection between the contact point section 175 and the circuit substrate 105 is possible when the handle 84 is rotated in the first rotation direction R1.

Figure 16:
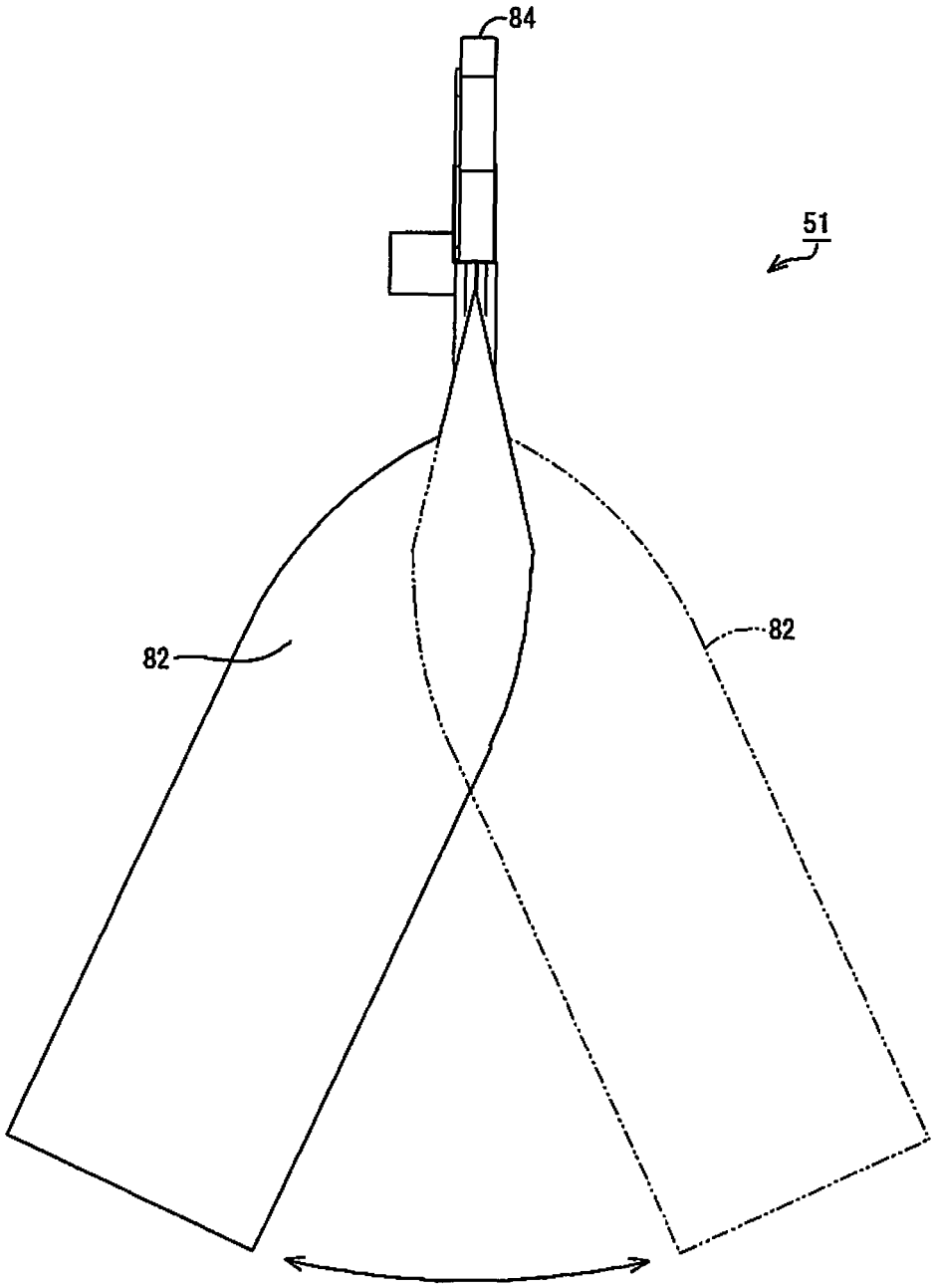
FIG. 16 is a diagram for explaining one example of the problem with ink containers.

In addition, in the present embodiment, it is easy for bending of the liquid containing section 82 back and forth to be avoided when, for example, the ink container 51 is shaken side to side in a state where the handle 84 is held since the handle 84 is able to be rotated with regard to the base member 91 in the ink container 51. Here, in a case where, for example, the handle 84 is configured so as to not rotate, there is bending back and forth of the ink containing section 82 in combination with shaking of the ink container 51 as shown in FIG. 16 when the ink container 51 is shaken side to side in a state of being supported by the handle 84. When the sheet member 82A, the sheet member 82B, and the sheet member 82C which configure the ink containing section 82 are repetitively bent back and forth, the materials become fatigued and it is easy for damage to occur. In contrast to this, in the present embodiment, it is easy for bending of the liquid containing section 82 back and forth to be avoided when the ink container 51 is shaken side to side in a state where the handle 84 is held since the ink container 51 is shaken side to side with the engagement section 155A and the engagement section 155B as pivots. For this reason, it is easy for damage to the liquid containing section 82 and the like to be suppressed.

Figure 17:
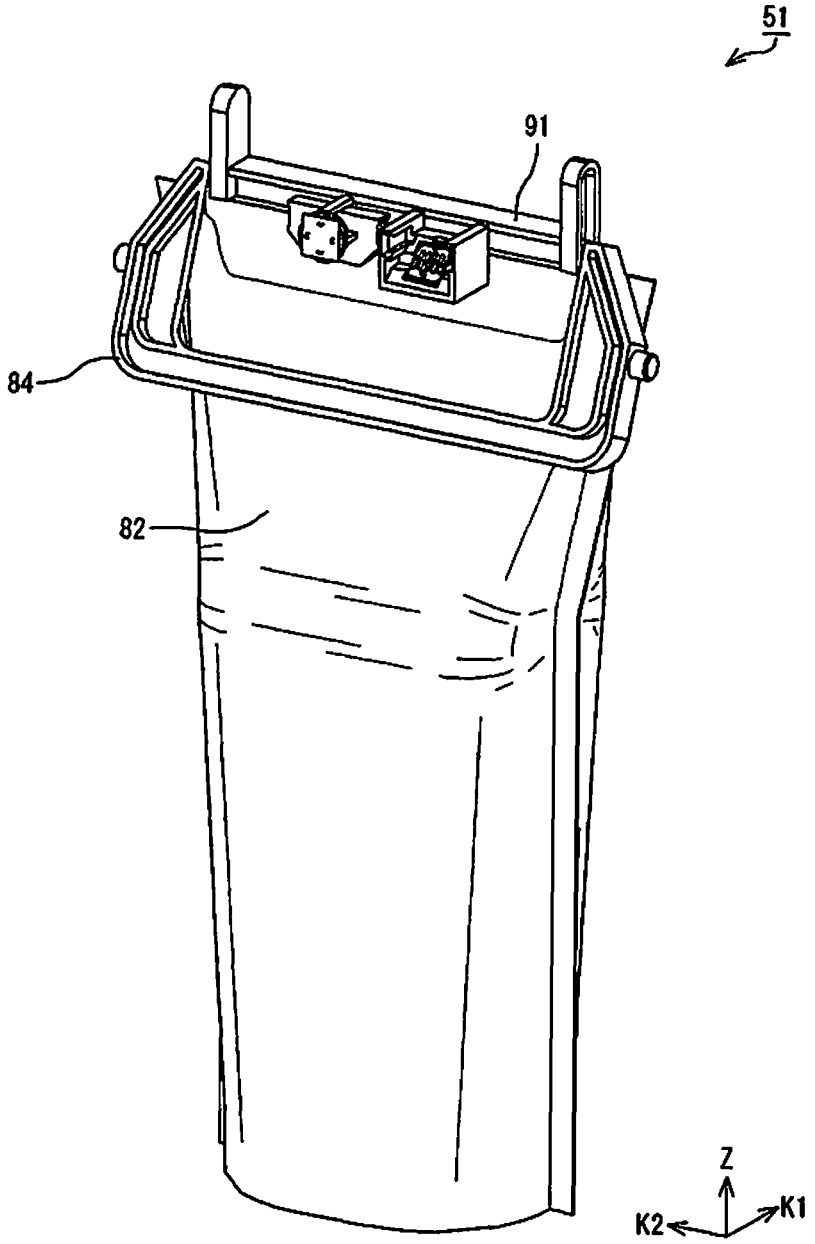
FIG. 17 is a diagram for explaining one example of the effects of an ink container in an embodiment of the present invention.

In addition, in the present embodiment, the handle 84 is able to be rotated with regard to the base member 91 in the ink container 51. For this reason, it is possible to, for example, suppress the amount by which the handle 84 protrudes by the handle 84 rotating to the ink containing section 82 side as shown in FIG. 17. Due to this, it is possible to reduce the size of the ink container 51. As such, in a case where, for example, the ink container 51 is in storage, it is possible to reduce the volume of space which is necessary for storage if the handle 84 is rotated to the ink containing section 82 side. In addition, for example, it is easy for costs to be reduced since it is easy for volume to be reduced in transportation if the handle 84 is rotated to the ink containing section 82 side.

Figure 18:
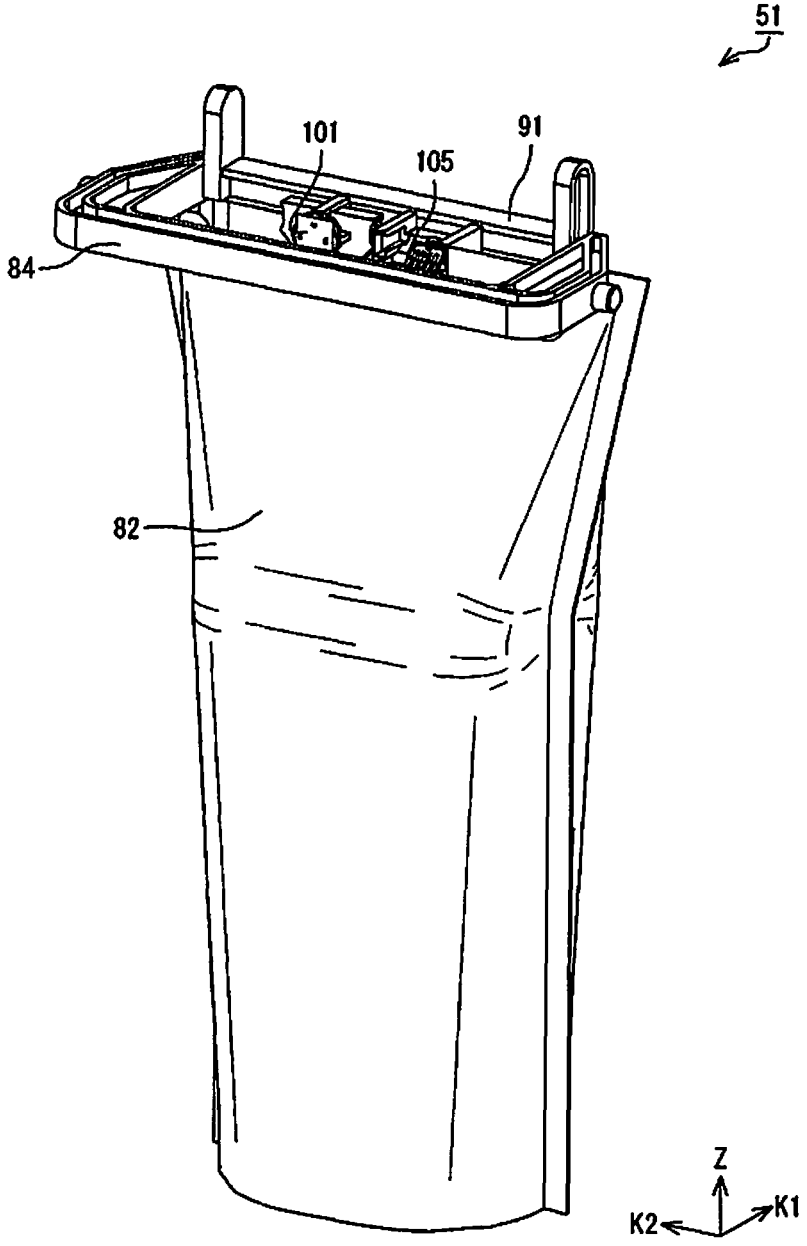
FIG. 18 is a diagram for explaining one example of the effects of an ink container in an embodiment of the present invention.

In addition, it is preferable for the position where rotation of the handle 84 stops when the handle 84 is rotated to the ink extraction section 101 side (when rotated in the second rotation direction R2) to be set to a position where the handle 84 overlaps with the ink extraction section 101 and the circuit substrate 105 when viewed from the K1 direction as shown in FIG. 18. According to this positioning, when, for example, the ink container 51 falls over from a state where the ink container 51 is stood up on the floor or the like so that the Z axis direction of the ink container 51 faces vertically upward, it is easy to avoid the ink extraction section 101 and the circuit substrate 105 hitting against the floor. That is, it is easy for the ink extraction section 101 and the circuit substrate 105 to be protected by the handle 84.

Figure 19:
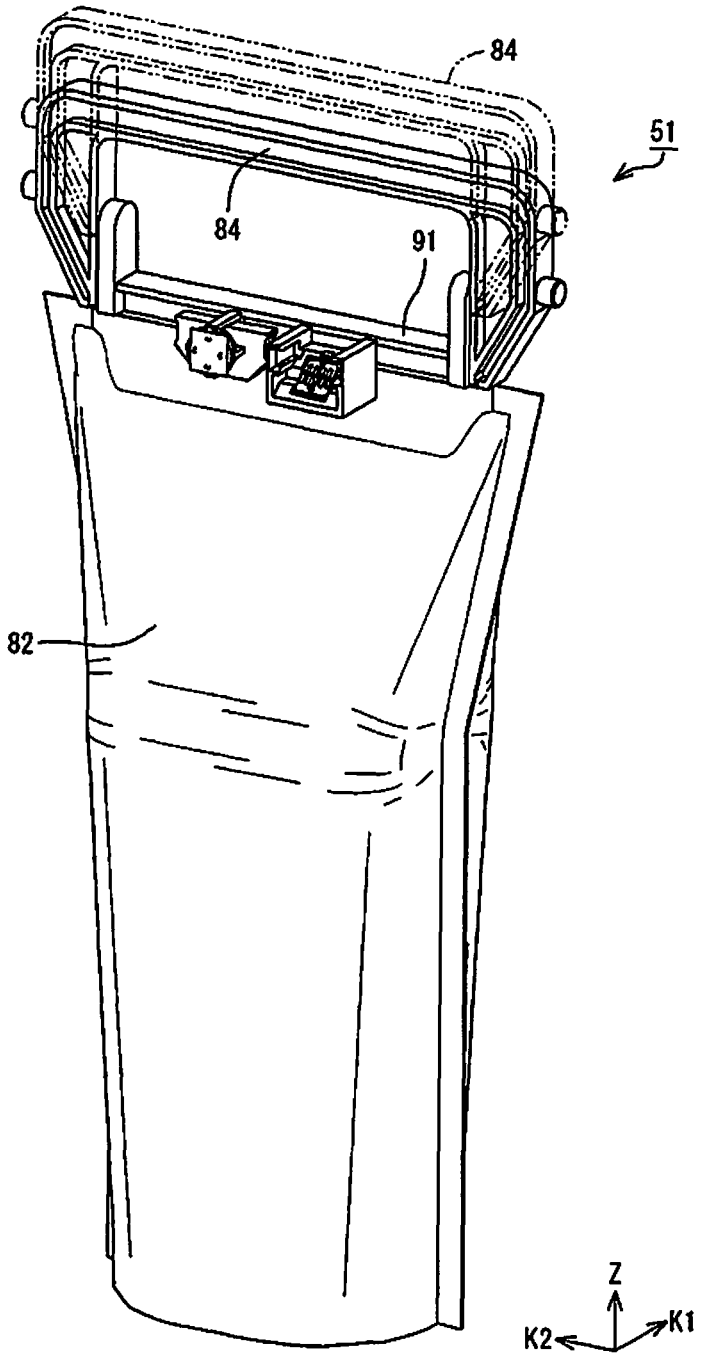
FIG. 19 is a diagram for explaining one example of the effects of an ink container in an embodiment of the present invention.

In addition, in the present embodiment, the engagement section 155A and the engagement section 155B in the handle 84 are able to slide along the grooves 125 with which the engagement section 155A and the engagement section 155B are engaged in the ink container 51. For this reason, the handle 84 is able to be raised and lowered with regard to the base member 91 as shown in FIG. 19. Due to this, in a case where, for example, the ink container 51 is in storage, it is possible to reduce the volume of space which is necessary for storage if the handle 84 is lowered to the ink containing section 82 side. On the other hand, gripping is easy since it is possible for the gap between the handle 84 and the base member 91 to be widened if the handle 84 is raised (as in the two-dot chain line in the diagram) in a case where the ink container 51 is moved. In this manner, it is convenient since it is possible for the handle 84 to be raised and lowered according to storage or movement of the ink container 51.

Here, in the present embodiment, a configuration is adopted where the holder 172 is fixed to the printer 3 in the attaching and detaching unit 171. For this reason, the moveable member 177 is shifted in the attaching and detaching unit 171. However, the configuration of the attaching and detaching unit 171 is not limited to this. It is possible to also adopt a configuration as the attaching and detaching unit 171 where the moveable member 177 is fixed to the printer 3. In this configuration, the holder 172, the ink introduction section 173, and the contact point mechanism 175 are shifted. That is, in the configuration where the moveable member 177 is fixed to the printer 3, the holder 172, the support member 181, the ink introduction section 173, and the contact point mechanism 175 are shifted in the K1 direction as shown in FIG. 10 when the handle 84 is rotated with the engagement section 123 of the ink container 51 being supported by the support section 183. Even with this configuration, it is possible for the ink extraction section 101 and the ink introduction section 173 to be connected and for connection between the ink extraction section 101 and the ink introduction section 173 to be released by the handle 84 being rotated.

In addition, in the present embodiment, the receiving sections 203 are formed in the support sections 202 and the protruding sections 157 are formed in the handle 84. However, the configuration of the handle 84 and the support sections 202 is not limited to this. It is possible to adopt a configuration as the configuration of the handle 84 and the support section 202 where, for example, the protruding sections 157 are formed in the support sections 202 and the receiving sections 203 are formed in the handle 84. It is possible for the same effects to be obtained even with this configuration.

Figure 20:
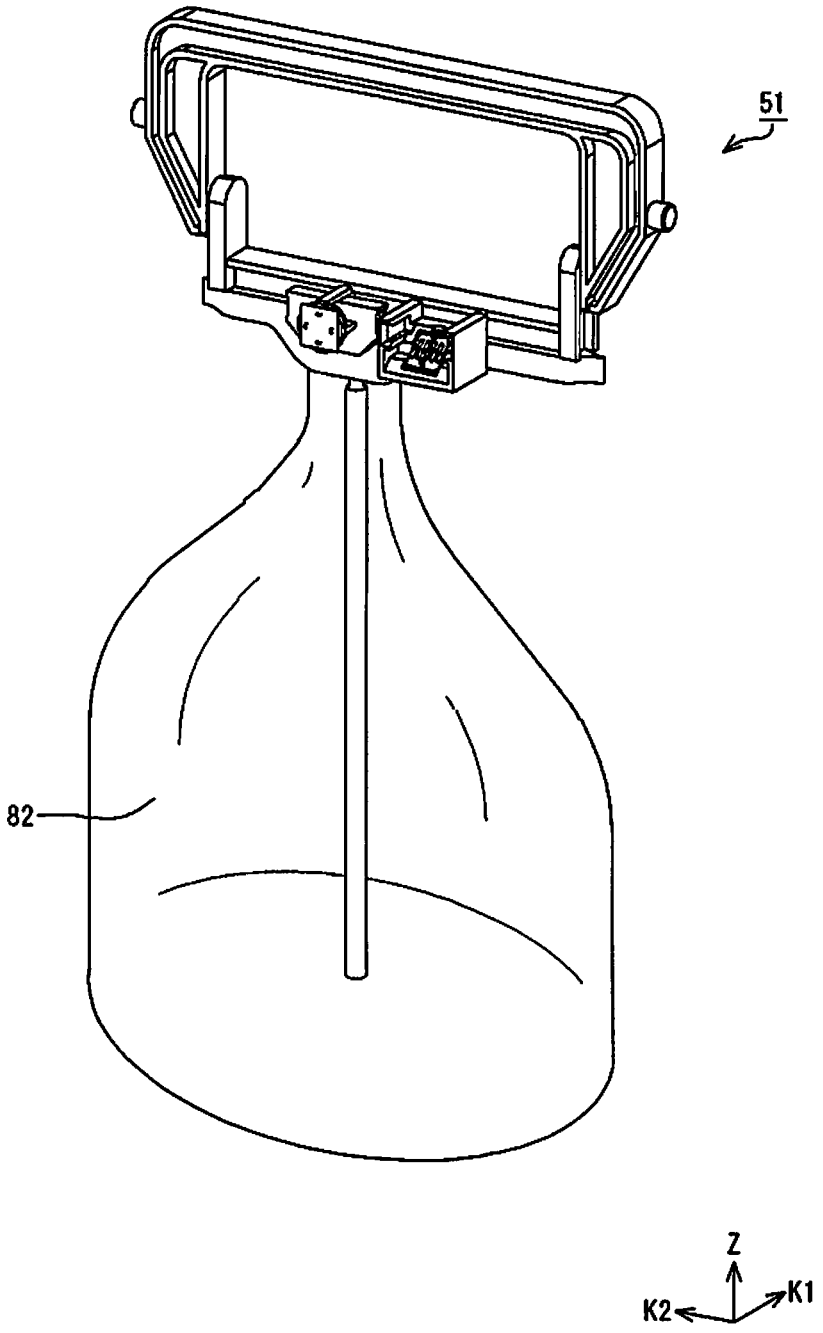
FIG. 20 is a diagram illustrating another example of an ink container in an embodiment of the present invention.

In addition, in the present embodiment, the ink containing section 82 is configured by joining together the sheet member 82A, the sheet member 82B, and the sheet member 82C. However, the configuration of the ink containing section 82 is not limited to this. It is possible to adopt a configuration as the ink containing section 82 where, for example, the ink containing section 82 is a vessel with flexibility which is formed by blow molding as shown in FIG. 20 or the like. It is possible for the same effects to be obtained even with this configuration.

DESCRIPTION OF REFERENCE NUMERALS

1 LIQUID EJECTING SYSTEM; 3 PRINTER; 4 INK SUPPLY APPARATUS; 5 TRANSPORT APPARATUS; 6 RECORDING SECTION; 7 MOVEMENT APPARATUS; 9 RELAY APPARATUS; 11 CONTROL SECTION; 12A DRIVE ROLLER; 12B DRIVEN ROLLER; 13 TRANSPORT MOTOR; 17 CARRIAGE; 19 RECORDING HEAD; 31 FLEXIBLE CABLE; 41A, 41B PULLEY; 43 TIMING BELT; 45 CARRIAGE MOTOR; 47 GUIDE SHAFT; 51, 51C, 51K, 51M, 51Y INK CONTAINER; 53 CASE; 57 INK SUPPLY TUBE; 59 PUMP UNIT; 61 INK SUPPLY TUBE; 82 INK CONTAINING SECTION; 82A, 82B, 82C SHEET MEMBER; 83 FLOW PATH UNIT; 84 HANDLE; 85 PERIPHERAL EDGE REGION; 86 BONDING SECTION; 91 BASE MEMBER; 93 TUBE; 94 VALVE UNIT; 95 SPRING; 97 PLUG; 99 PACKING; 101 INK EXTRACTION SECTION; 102 BASE SECTION; 103 FILM; 105 CIRCUIT SUBSTRATE; 106 SUBSTRATE INSTALLATION SECTION; 107 TERMINAL SECTION; 108 INTRODUCTION OPENING; 121, 121A, 121B RAIL SECTION; 123 ENGAGEMENT SECTION; 125 GROOVE; 141 BOTTOM SECTION; 142 SIDE WALL; 143 OPENING SECTION; 145 GROOVE; 146 TERMINAL END; 147 SUPPLY NEEDLE; 148 FLOW PATH; 151 GRIP SECTION; 153, 153A, 153B LEG SECTION; 155A, 155B ENGAGEMENT SECTION; 157A, 157B PROTRUDING SECTION; 171 ATTACHING AND DETACHING UNIT; 172 HOLDER; 173 INK INTRODUCTION SECTION; 175 CONTACT POINT MECHANISM; 177 MOVEABLE MEMBER; 181, 181A, 181B SUPPORT MEMBER; 183 SUPPORT SECTION; 185 NOTCH SECTION; 187 RECESS SECTION; 189A, 189B SLIDE SECTION; 191A, 191B GUIDE SECTION 201, 201A, 201B LEG SECTION; 202, 202A, 202B SUPPORT SECTION; 203, 203A, 203B RECEIVING SECTION; 207 END SURFACE; 211 FIRST HYPOTHETICAL PLANE; and 212 SECOND HYPOTHETICAL PLANE.

The invention claimed is:

1. A liquid container, which is able to be attached to and detached from a liquid supply apparatus which supplies liquid to a liquid ejecting apparatus, comprising:

a liquid containing section which has flexibility and which contains the liquid;

a base member which is positioned on an end section of the liquid containing section and which protrudes more to the outer side than the liquid containing section;

a liquid extraction section which is provided in the base member and which forms a flow path which is linked with an inner section of the liquid containing section via the base member; and a handle section which is provided so as to be able to be rotated with regard to the base member.

2. The liquid container according to claim 1, wherein an end surface of the liquid extraction section faces toward a direction which intersects with the protruding direction of the handle section from the base member when the liquid container is supported by the handle section being gripped and the handle section protrudes more to the opposite side to the liquid containing section side than the base member.

3. The liquid container according to claim 1, wherein the base member is further provided with a contact section which is able to connect with an electricity connection section which is provided in the liquid supply apparatus.

4. The liquid container according to claim 1, wherein the liquid container is provided with a first engagement section which is able to engage with the liquid supply apparatus, the first engagement section is provided on the handle section of the liquid container, the liquid supply apparatus is provided with a first support section which supports the liquid extraction section of the liquid container, a liquid introduction section which is connected with the liquid extraction section and which is supplied with the liquid, which is inside the liquid containing section, from the liquid extraction section, and a second support section which supports the first engagement section of the handle section, and the liquid extraction section and the liquid introduction section are connected to each other when the handle section is rotated in a first rotation direction with the first engagement section of the handle section as a pivot from a state where connection between the liquid extraction section and the liquid introduction section is released, and connection between the liquid extraction section and the liquid introduction section is released when the handle section is rotated in a second rotation direction which is opposite to the first rotation direction with the first engagement section of the handle section as a pivot from a state where the liquid extraction section and the liquid introduction section are connected to each other.

5. The liquid container according to claim 4, wherein a third engagement section is provided in the liquid extraction section of the liquid container, the third engagement section engages with the first support section of the liquid supply apparatus, and the liquid extraction section is supported by the first support section via the third engagement section.

6. A liquid supply apparatus, which is mounted with a liquid container, which contains liquid, so as to be able to be attached and detached and which is able to supply a liquid ejecting apparatus with the liquid which is contained in the liquid container, wherein where the liquid container is provided with a liquid containing section which has flexibility and which contains the liquid, a base member which is positioned on an end section of the liquid containing section and which protrudes more to the outer side than the liquid containing section, a liquid extraction section which is provided in the base member to protrude from the base member and which forms a flow path which is linked with an inner section of the liquid containing section via the base member, a handle section which is provided so as to be able to be rotated with regard to the base member, and a first engagement section which is provided on the handle section and which is able to engage with the liquid supply apparatus, the first engagement section is provided on the handle section of the liquid container, the liquid supply apparatus is provided with a first support section which supports the liquid extraction section, a liquid introduction section which is connected with the liquid extraction section and which is supplied with the liquid, which is inside the liquid containing section, from the liquid extraction section, and a second support section which supports the first engagement section of the handle section, and the liquid extraction section and the liquid introduction section are connected to each other when the handle section is rotated in a first rotation direction with the first engagement section of the handle section as a pivot from a state where connection between the liquid extraction section and the liquid introduction section is released, and connection between the liquid extraction section and the liquid introduction section is released from a state where the liquid extraction section and the liquid introduction section are connected to each other when the handle section is rotated in a second rotation direction which is opposite to the first rotation direction with the first engagement section of the handle section as a pivot.

7. The liquid supply apparatus according to claim 6, wherein an end surface of the liquid extraction section faces toward a direction which intersects with the protruding direction of the handle section from the base member when the liquid container is supported by the handle section of the liquid container being gripped and the handle section protrudes more to the opposite side to the liquid containing section side than the base member.

8. The liquid supply apparatus according to claim 6, wherein the liquid extraction section and the liquid introduction section line up in a first direction which intersects with the direction of gravity when the liquid extraction section of the liquid container is supported by the first support section of the liquid supply apparatus, the handle section is further provided with a second engagement section which engages with the base member so as to be able to be rotated, an engagement target section, which engages with the second engagement section of the handle section and which is able to slide with the second engagement section, is formed in the base member, the engagement target section extends in a second direction which intersects with the first direction in a state where the liquid extraction section is supported by the first support section of the liquid supply apparatus, and the position of the first engagement section of the handle section is higher than the position of the second engagement section in a state where connection between the liquid extraction section and the liquid introduction section is released.

9. The liquid supply apparatus according to claim 6, wherein the first support section of the liquid supply apparatus is shifted by the handle section of the liquid container being rotated.

10. The liquid supply apparatus according to claim 6, wherein a third engagement section is provided in the liquid extraction section of the liquid container, the third engagement section engages with the first support section of the liquid supply apparatus, and the liquid extraction section is supported by the first support section via the third engagement section.

11. A liquid container, which is able to be attached to and detached from a liquid supply apparatus which supplies liquid to a liquid ejecting apparatus, comprising:

a liquid containing section which has flexibility and which contains the liquid;

a base member which is positioned on an end section of the liquid containing section and which protrudes more to the outer side than the liquid containing section;

a liquid extraction section which is provided in the base member, which forms a flow path which is linked with an inner section of the liquid containing section via the base member, and which has an end surface which is open to the outside;

a handle section which is provided so as to be able to be rotated with regard to the base member between a first state along a first hypothetical plane which is parallel with the end surface of the liquid extraction section and a second state along a second hypothetical plane which intersects with the end surface of the liquid extraction section; and a first engagement section which is an engagement section, which is provided in the handle section and which is able to engage with the liquid supply apparatus, and which is a pivot for rotation when the handle section rotates from the first state to the second state and where it is possible for the base member to be operated so that the and surface of the liquid extraction section moves in a direction toward the end surface.

12. The liquid container according to claim 11, wherein an end surface of the liquid extraction section faces toward a direction which intersects with the protruding direction of the handle section from the base member when the liquid container is supported by the handle section being gripped and the handle section protrudes more to the opposite side to the liquid containing section side than the base member.

* * * * *